US007540581B2

(12) United States Patent
Someno

(10) Patent No.: US 7,540,581 B2
(45) Date of Patent: Jun. 2, 2009

(54) PRINT CONTROL METHOD

(75) Inventor: Masahiro Someno, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 211 days.

(21) Appl. No.: 11/326,899

(22) Filed: Jan. 6, 2006

(65) Prior Publication Data

US 2006/0164674 A1 Jul. 27, 2006

(30) Foreign Application Priority Data

Jan. 6, 2005 (JP) ..... 2005-001522
Jan. 6, 2005 (JP) ..... 2005-001568
Feb. 4, 2005 (JP) ..... 2005-029352

(51) Int. Cl.
*B41J 29/393* (2006.01)

(52) U.S. Cl. ..... 347/19

(58) Field of Classification Search ..... None
See application file for complete search history.

(56) References Cited

U.S. PATENT DOCUMENTS 5,636,032 A * 6/1997 Springett ..... 358/296
2002/0001007 A1* 1/2002 Horigome ..... 347/19
2002/0163569 A1* 11/2002 Shibuya ..... 347/172
2004/0054623 A1* 3/2004 Collins et al. ..... 705/39

FOREIGN PATENT DOCUMENTS

| | | |
|---|---|---|
| JP | 06-199018 | 7/1994 |
| JP | 09-171065 | 6/1997 |
| JP | 11-058898 | 3/1999 |
| JP | 2000-071580 | 3/2000 |
| JP | 2002-283670 | 10/2002 |
| JP | 2003-048327 | 2/2003 |

OTHER PUBLICATIONS

Translation of JP 11-058898.*

* cited by examiner

*Primary Examiner*—Matthew Luu
*Assistant Examiner*—Justin Seo
(74) *Attorney, Agent, or Firm*—Edwards Angell Palmer & Dodge LLP

(57) ABSTRACT

A print control method comprising the steps of measuring a battery remainder index correlating with a remaining capacity of a battery in a printing unit operating on the battery, specifying a number of remaining printable copies of the printing unit on the basis of the battery remainder index, and outputting the number of remaining printable copies.

6 Claims, 23 Drawing Sheets

(A)

91

Able to print

| | |
|---|---|
| Paper size | 5 × 7 in |
| Paper type | Photographic paper |
| Print quality | Quality |
| No. of copies | 1 |

(B)

92

Shortage of battery remaining capacity. Unable to print completely.

FIG. 28

PRINT CONTROL METHOD

CROSS REFERENCE TO RELATED APPLICATIONS

Disclosure of JP-A-2005-001522 (filed on Jan. 6, 2005), JP-A-2005-001568 (filed on Jan. 6, 2005), and JP-A-2005-029352 (filed on Feb. 4, 2005), each including the specification, drawing, and abstract, is entirely incorporated herein by reference.

BACKGROUND OF THE INVENTION

1. Technical Field

The invention relates to a print control method and a printing system, and more particularly to a method for controlling a printing unit operating on a battery.

2. Description of the Related Art

Recently, as digital cameras are used widely, photographic printing by using printers is realized everywhere. Conventional printers generally consume electric power from building electric wiring, and cannot be used outdoors, and since power cords must be plugged and unplugged, and it is hard and complicated to move the place of installation. In such circumstance, it seems there is a considerable latent need for printing operating on batteries. However, as far as batteries are used as power source, the operating time is determined by the remainder of battery, the user cannot use the printer safely unless the remaining capacity of battery is known. Methods of detecting the remaining capacity of battery are known, for example as disclosed in JP-A-9-171065. If, however, the remaining capacity of battery is known, it is extremely difficult to know how many pages can be printed more at a certain remaining capacity of battery.

JP-A-2003-48327 discloses a printer capable of displaying the number of pages that can be printed depending on the remainder of the ink as coloring material (the number of remaining printable copies). With such printer, the user can print safely without fear of running out of ink in the midst of printing if the ink remainder becomes small.

JP-A-2002-283670 discloses a printing system in which the total number of pages to be printed and the number of remaining printable copies specified by the remainder of the ink as coloring material are compared when printing of pages is instructed, and printing is stopped by outputting an alarm when the number of remaining printable pages is smaller than the total number of pages to be printed. The total number of pages to be printed corresponds to the product of the number of pages per copy and the number of copies. According to such printing system, the user knows whether printing is completed until the end before starting printing, so that the printer can be used safely without fear of running out of the ink in the midst of operation.

SUMMARY

It is hence an object of the invention to present a print control method and a printing system capable of allowing the user to recognize the number of remaining printable copies depending on the remaining capacity of battery.

(1) To achieve the object, a first print control method measures a battery remainder index correlating with the remaining capacity of a battery in a printing unit operating on the battery, specifies the number of remaining printable copies of the printing unit on the basis of the battery remainder index, and outputs the number of remaining printable copies. According to this print control method, the battery remainder index correlating with the remaining capacity of a battery is measured, and the number of remaining printable copies is outputted on the basis of the battery remainder index, so that the user knows the number of remaining printable copies depending on the battery remaining capacity.

(2) The first print control method may also set a print mode of the printing unit. Further, when specifying the number of remaining printable copies, the number of remaining printable copies may be specified depending on the set print mode. According to this print control method, if the capacity of battery consumed per unit page differs in each print mode, the user can recognize the number of remaining printable copies correctly depending on the remaining capacity of the battery.

(3) In the first print control method, the battery remainder index may be the terminal voltage of the battery. When specifying the number of remaining printable copies, by specifying the reference number of printed copies corresponding to the reference terminal voltage equal to the terminal voltage on the basis of the mapping information correlating between the reference terminal voltage of the battery and the reference number of printed copies corresponding to the cumulative number of printable pages from the fully charged state, the number of printable copies may be determined on the basis of the specified reference number of printed copies and the predetermined upper limit value. By this print control method, since the reference number of printed copies corresponding to the reference terminal voltage equal to the terminal voltage is specified on the basis of the mapping information correlating between the reference terminal voltage of the battery and the reference number of printed copies corresponding to the cumulative number of printable pages from the fully charged state, and the number of printable copies is determined on the basis of the specified reference number of printed copies and the predetermined upper limit value, the number of remaining printable copies can be determined without specifying the remaining capacity of battery on the basis of the measured terminal voltage of the battery. The reference number of printed copies is specific in the printing time per unit page in the same object of printing, and, for example, the cumulative printing time from the fully charge state may be utilized. Or the cumulative number of printing pages from the fully charge state may be utilized as the reference number of printed copies. The predetermined upper limit value is, for example, the maximum number of printable pages by using the standard solid body of battery in fully charged state.

(4) In the first print control method, the battery is a secondary battery, and the reference number of printed copies may be a reference cumulative printing time. This print control method may also correct the number of remaining printable copies by specifying a plurality of reference cumulative printing time corresponding to a plurality of reference terminal voltages mutually equal to the battery remainder indices detected a plurality of times on the basis of the mapping information, specifying the theoretical printing time per unit page on the basis of the specified reference cumulative printing time, and correcting the number of remaining printable copies on the basis of the ratio of the specified theoretical printing time and reference printing time per unit page. Further, at the time of output of the number of remaining printable copies, the corrected number of remaining printable copies may be outputted. Generally, discharge capacity of secondary battery decreases in the process of repetition of charge and discharge (so-called cycle deterioration). As a result, decline of terminal voltage corresponding to the quantity of current discharged by secondary battery is accelerated. In other words, the characteristic curve showing the relation of cumulative printing time of secondary battery and terminal voltage is compressed in the direction of time axis depending on decrease of discharge capacity of secondary battery. Consequently, the correlation of mapping information and characteristic curve corresponding between the reference cumulative printing time and terminal voltage is lowered. That is, the error between the number of remaining printable copies specified by mapping information and the actual number of remaining printable copies increases along with progress of cycle deterioration of secondary battery. However, according to this print control method, the theoretical printing time is specified by detecting the reference terminal voltage a plurality of times, and the number of remaining printable copies is corrected on the basis of the ratio of theoretical printing time and reference printing time. Herein, the ratio of theoretical printing time and reference printing time correlates with the compression rate of the above described characteristic curve in the direction of time axis. According to this print control method, therefore, since the number of remaining printable copies specified by the mapping information is corrected on the basis of such ratio, if the secondary battery deteriorates in cycle, the user can correctly recognize the number of remaining printable copies corresponding to the remaining capacity of secondary battery.

(5) The first print control method may also set a print mode of the printing unit. Further, when specifying the number of remaining printable copies, the number of remaining printable copies may be also specified depending on a set print mode. According to this print control method, if the capacity of battery consumed per unit page differs in each print mode, the user can correctly recognize the number of remaining printable copies corresponding to the remaining capacity of battery.

(6) In the first print control method, the mapping information may correlates the reference number of printed copies with the reference terminal voltage in each print mode. Further, when specifying the number of remaining printable copies, the number of remaining printable copies depending on the set print mode may be also specified on the basis of the mapping information according to the set print mode. According to this print control method, since the number of remaining printable copies is specified on the basis of mapping information of each print mode stored in nonvolatile recording medium, the number of remaining printable copies corresponding to the remaining capacity of battery in each print mode can be specified correctly.

(7) When specifying the number of remaining printable copies in the first print control method, the number of remaining printable copies specified on the basis of the only mapping information may be corrected according to the set print mode. In this print control method, since the number of remaining printable copies specified by mapping information is corrected in every print mode, the number of remaining printable copies depending on remaining capacity of battery can be specified correctly in each print mode.

(8) In the first print control method, a menu of print mode of the printing unit may be displayed together with the number of remaining printable copies in each print mode. According to this print control method, the menu of print mode is displayed together with the number of remaining printable copies in each print mode, and the user is free to select a desired print mode depending on the desired number of copies to be printed.

(9) When specifying the number of remaining printable copies in the first print control method, the printing unit may update the number of remaining printable copies every time the specified number of pages are printed. Further, when outputting the number of remaining printable copies, the updated number of remaining printable copies may be outputted during printing. According to this print control method, since the number of remaining printable copies to be updated is outputted during printing, the user can stop printing, charge or take necessary action before printing is disabled due to drop of remaining capacity, and it hence prevent troubles of waste of paper or ink due to interrupted printing in the midst of a page.

(10) When outputting the number of remaining printable copies in the first print control method, if the battery remainder index is larger than reference value, the battery remainder index may be outputted, and if the battery remainder index is less than the reference value, the number of remaining printable copies may be outputted.

(11) To achieve the object, a first printing system includes a circuit that measures the battery remainder index correlating with the remaining capacity of battery of printing unit operating on battery as power source, a unit that specifies the number of remaining printable copies of the printing unit on the basis of the battery remainder index, and a unit that outputs the number of remaining printable copies.

(12) To achieve the object, a second print control method comprising; measuring a battery remainder index correlating with the remaining capacity of the battery of a printing unit that forms an image on a printing medium by fixing a coloring material on the printing medium operating on the battery as power source, specifying a first number of remaining printable copies of the printing unit on the basis of the battery remainder index, acquiring a coloring material remainder index correlating with the remainder of the coloring material, specifying a second number of remaining printable copies of the printing unit on the basis of the coloring material remainder index, and outputting an actual number of remaining printable copies on the basis of the first number of remaining printable copies and the second number of remaining printable copies. According to this print control method, the first number of remaining printable copies is specified on the basis of the battery remainder index correlating with the remaining capacity of battery, and the second number of remaining printable copies is specified on the basis of the coloring material remainder index correlating with the remainder of the coloring material, and the actual number of remaining printable copies on the basis of the first number of remaining printable copies and the second number of remaining printable copies is outputted, so that the user can recognize the actual number of remaining printable copies corresponding to the remaining capacity of the battery and the remainder of the coloring material.

(13) When outputting the number of remaining printable copies in the second print control method, either the first number of remaining printable copies or the second number of remaining printable copies, whichever the smaller may be outputted as the actual number of remaining printable copies. According to this print control method, since the smaller number of either first number of remaining printable copies or second number of remaining printable copies is outputted as the actual number of remaining printable copies, the user will not misunderstand the greater number of either first number of remaining printable copies or second number of remaining printable copies as the actual number of remaining printable copies.

(14) The second print control method may also set a print mode of the printing unit. Further, when specifying the first number of remaining printable copies, the first number of remaining printable copies may be specified depending on the set print mode. Also when specifying the second number of remaining printable copies, the second number of remaining printable copies may be specified depending on the set print mode. According to this print control method, since the first number of remaining printable copies and second number of remaining printable copies are specified depending on the print mode, if the capacity of battery consumed per unit page or the consumption of coloring material differs in each print mode, the user can recognize the actual number of remaining printable copies correctly in consideration of the remaining capacity of battery and remainder of coloring material.

(15) To achieve the object, a second printing system including a battery remainder measuring circuit that measures a battery remainder index correlating with the remaining capacity of the battery of a printing unit that forms an image on a printing medium by fixing a coloring material on the printing medium operating on the battery as power source, a first specifying unit that specifies a first number of remaining printable copies of the printing unit on the basis of the battery remainder index, an acquiring unit that acquires a coloring material remainder index correlating with the remainder of the coloring material, a second specifying unit that specifies a second number of remaining printable copies of the printing unit on the basis of the coloring material remainder index, and an output unit that outputs an actual number of remaining printable copies on the basis of the first number of remaining printable copies and the second number of remaining printable copies.

(16) To achieve the object, a third print control method comprising: acquiring a total number of pages to be printed of the pages to be printed by a printing unit that prints an image on a printing medium by fixing a coloring material on the printing medium operating on the battery as power source, acquiring a battery remainder index correlating with the remaining capacity of the battery, specifying a number of remaining printable copies on the basis of the battery remainder index, and warning on the basis of the total number of printing pages and the number of remaining printable pages before starting printing the pages to be printed by the printing unit. According to this print control method, since it is warned on the basis of the number of remaining printable pages specified by the battery remainder index correlating with the remaining capacity of battery and the total number of printing pages before starting printing, so that the user knows whether the battery runs out or not during printing before starting printing. Thus, the invention prevents battery shortage during printing.

(17) The third print control method may also set a print mode of the printing unit. Further, in this printing system, the specifying unit that specifies the number of remaining printable copies may also specify the number of remaining printable copies on the basis of the battery remainder index and the print mode. According to this print control method, since the print mode is related with the number of remaining printable copies, more accurate number of remaining printable copies can be obtained.

(18) The third print control method may also acquire a coloring material remainder index correlating with the remainder of the coloring material. When specifying the number of remaining printable copies in this print control method, the first number of remaining printable copies is specified on the basis of the battery remainder index, and also the second number of remaining printable copies is specified on the basis of the coloring material remainder index, and either the first number of remaining printable copies or the second number of remaining printable copies, whichever the smaller may be specified as the number of remaining printable copies. According to this print control method, shortage of coloring material during printing can be also prevented.

(19) To achieve the object, a third printing system comprises a printing unit that prints an image on a printing medium by fixing a coloring material on the printing medium operating on the battery as power source, an acquiring unit that acquires a total number of pages to be printed of the total number of pages to be printed by the printing unit, an acquiring unit that acquires a battery remainder index correlating with the remaining capacity of the battery, a specifying unit that specifies a number of remaining printable copies on the basis of the battery remainder index, and a warning unit that warns depending on the total number of pages to be printed and the number of remaining printable pages. According to this printing system, battery shortage during printing can be prevented.

The procedure of operations of the methods described herein is not particularly specified as far as the technical aspects are satisfied, and the sequence of operations is not particularly specified and may be executed at the same time. Functions of a plurality of units of the printing system are realized by hardware resources having the functions specified by the structure, hardware resources having the functions specified by the program, and the combination thereof. Functions of these plurality of units are not limited to those realized by hardware resources individually independent physically.

BRIEF DESCRIPTION OF THE DRAWINGS

The present invention will be readily understood by the following detailed description in conjunction with the accompanying drawings, wherein like reference numerals designate like structural elements, and in which:

FIG. 28 is a schematic diagram.

DETAILED DESCRIPTION OF THE PREFERRED EMBODIMENTS

Figure 1:
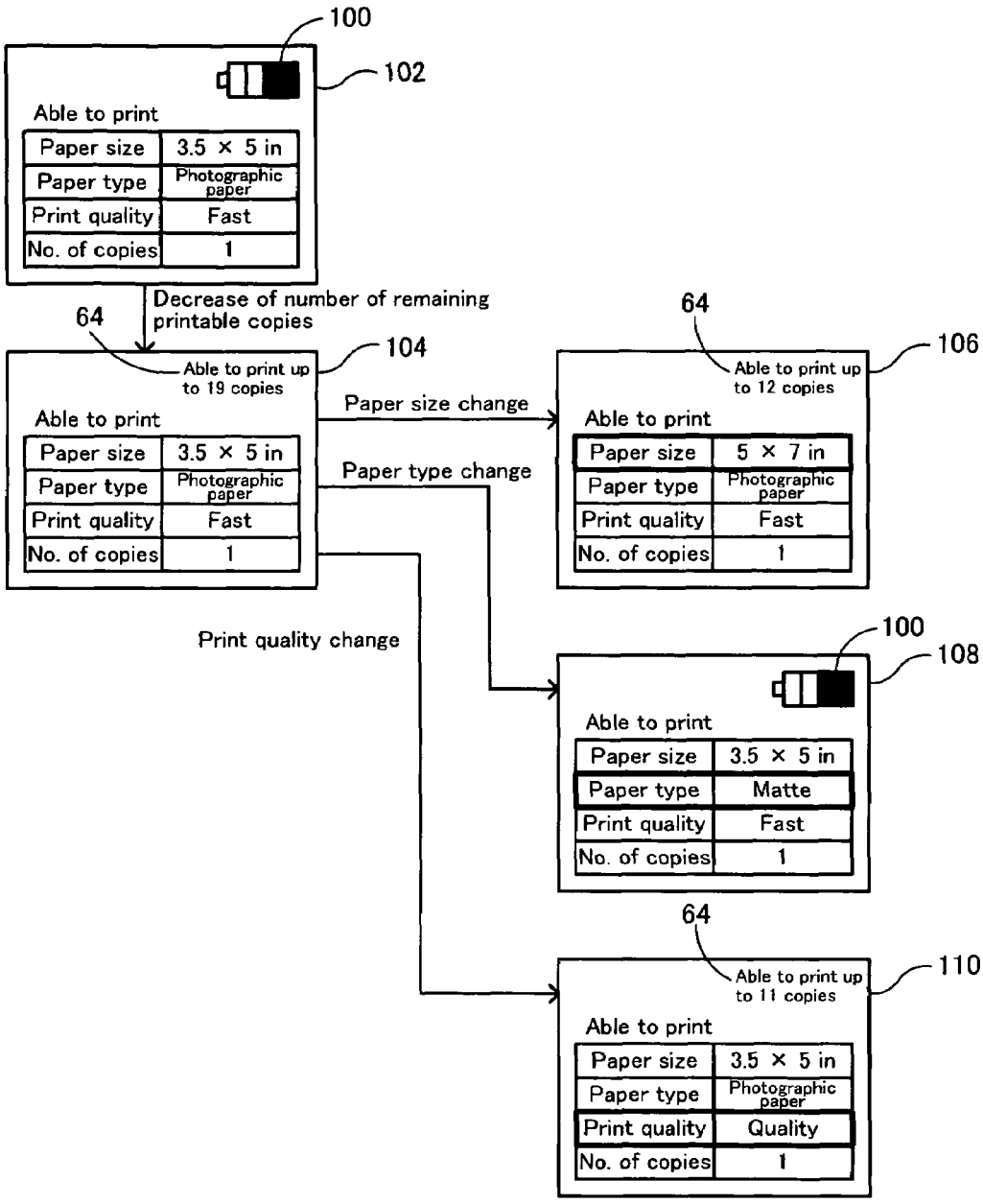
FIG. 1 is a screen transition diagram.

As the invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims. In the following embodiments, same reference numerals refer to same components.

First Embodiment

Figure 2:
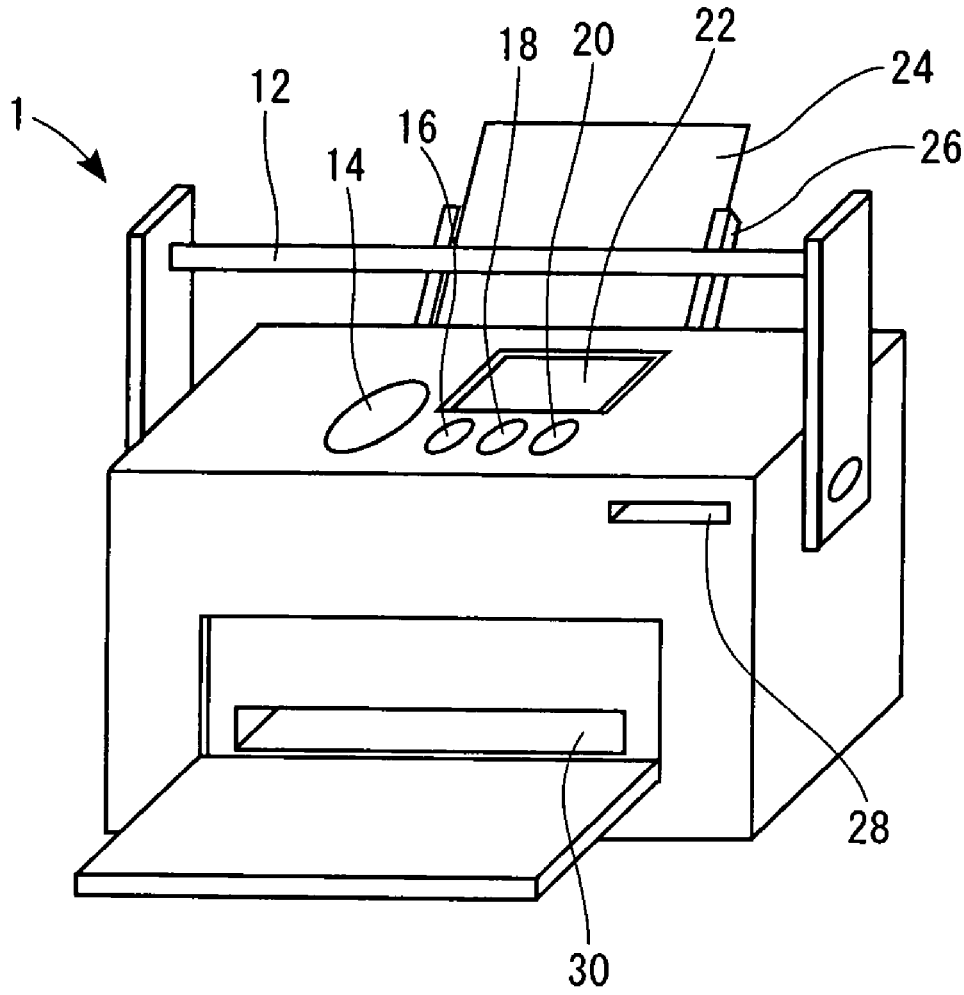
FIG. 2 is a perspective diagram.
Figure 3:
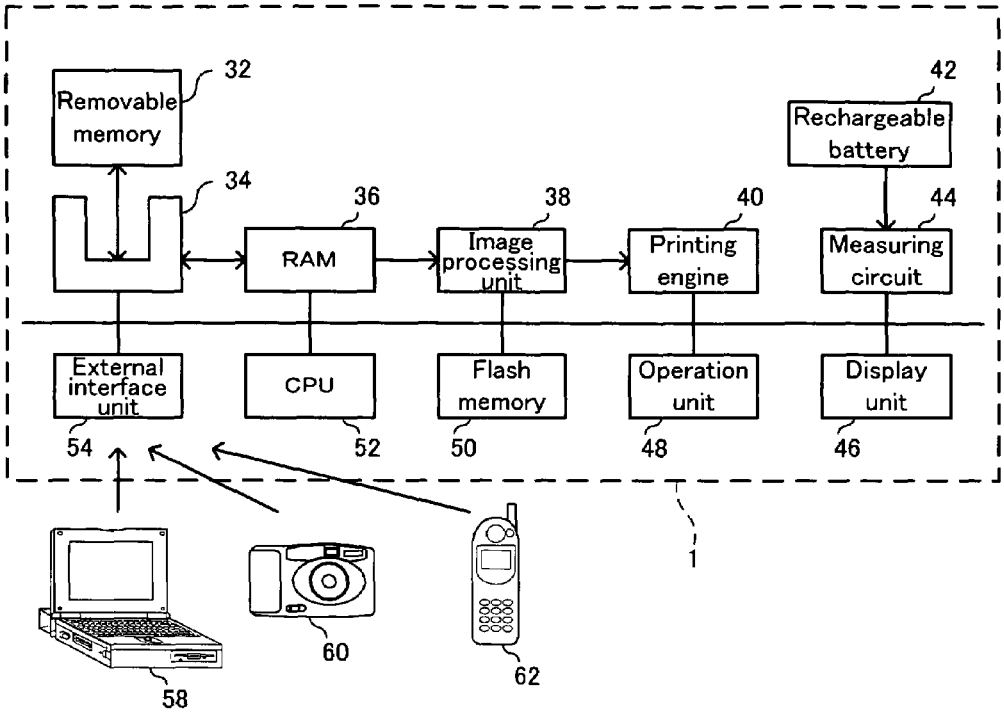
FIG. 3 is a schematic diagram.

FIG. 2 is a perspective view of outside of printer 1 as an embodiment of first printing system of the invention. FIG. 3 is a block diagram of hardware of printer 1. The printer 1 operates on a secondary battery 42 as a power source, and has a handle 12 for the convenience of portability. The printer 1 has functions of acquiring images stored in removable memory 32, digital camera 60, or portable telephone terminal 62, and is a stand-alone type photographic printer capable of printing images alone without help from personal computer 58 or the like.

An external memory controller 34 is connected to a removable memory 32 inserted in a card slot 28. Data stored in the removable memory 32 is read out by an external memory controller 34, and is transferred to a RAM 36.

An external interface unit 54 has USB controller, USB connector and others for communicating with external system such as PC58, digital camera 60 and portable telephone terminal 62. The external interface unit 54 may also have IEEE1394, IrDA (infrared data association), Bluetooth or other interface.

An image processing unit 38 as a printing unit is an ASIC for executing gamma correction, sharpness correction, resolution conversion, color space conversion (plate dividing), binary coding, interlace processing, and others. The image processing unit 38 processes the image to be printed by gamma correction and sharpness correction, converts the image to be printed to printing resolution, processes the image to be printed defined by color space of sRGB or the like and divides and converts into color space corresponding to ink colors such as CMY, further processes by binary coding and interlacing, and outputs binary printing data.

A printing engine 40 as printing unit includes a recording head for forming an image on paper 24 (see FIG. 2) by ink jet system, a drive unit for moving the recording head reciprocally, a paper feed unit and others. The recording head is mounted on a carriage having an ink cartridge, and has nozzle, piezoelectric element, driving circuit and others. The driving unit of the carriage has a motor, driving belt, driving circuit and others, and moves the carriage vertically to the conveying direction of paper 24 along the guide reciprocally. The paper feed unit rotates a paper conveying roller, and conveys the paper 24 from the paper feed tray 26 toward the paper discharge port 30 (see FIG. 2). The printing method of the printing engine 40 may be laser system, heat transfer system or the like and is not specified.

The RAM 36 is a volatile memory temporarily storing control program or data to be processed by control program. The RAM 36 stores data acquired by, for example, external memory controller 34 or external interface unit 54 from the removable memory 32, PC 58, digital camera 60, or portable telephone terminal 62.

The CPU 52 as an output unit that outputs the number of remaining printable copies, a specifying unit that specifies the number of remaining printable copies, a correction unit that corrects the number of remaining printable copies, a setting unit that sets print mode and a display unit that displays menu executes the control program stored in flash memory 50 which is nonvolatile recording medium, and controls parts of the printer 1. The control program may be stored in the flash memory 50 from computer readable recording medium such as removable memory 32, or may be stored in the flash memory 50 from a remote server by way of network.

An operation unit 48 as print mode setting unit includes a cross key 14, a decide key 16, a cancel key 18, and a print start key 20 for receiving menu operations from the user.

The display unit 46 as the output unit that outputs the number of remaining printable copies and a display unit that displays menu has liquid crystal display device such as graphic controller and LCD. Various menu and status are displayed on the screen 22 (see FIG. 2) of the liquid crystal display device.

The battery is the secondary battery 42, such as lithium ion secondary battery, nickel cadmium secondary battery, nickel hydrogen secondary battery, or lithium polymer secondary battery. The secondary battery 42 supplies electric power to parts of the printer 1. The battery may be also alkaline battery, manganese battery, other non rechargeable battery, or fuel cell.

A measuring circuit 44 is an analog-digital circuit for measuring the terminal voltage of the secondary battery 42 as the battery remainder index. The terminal voltage of the secondary battery 42 differs in printing status and waiting status depending on the internal resistance. In waiting status, therefore, the measuring circuit 44 corrects the measured terminal voltage by adding voltage drop due to internal resistance in printing status, converts the corrected voltage to digital signal, and outputs as terminal voltage to the CPU 52.

The measuring circuit 44 may also measure the remaining capacity of the secondary voltage 42 as battery remainder index. A method of measuring the remaining capacity of secondary battery 42 is disclosed, for example, in JP-A-9-171065, and may include open terminal voltage detecting method, integrating method, or other method. If the remaining capacity of secondary battery 42 can be measured correctly, the CPU 52 can specify the number of remaining printable copies from the electric power consumed by printing per page and the remaining capacity of secondary battery 42. This is the description of the hardware of the printer 1.

Figure 4:
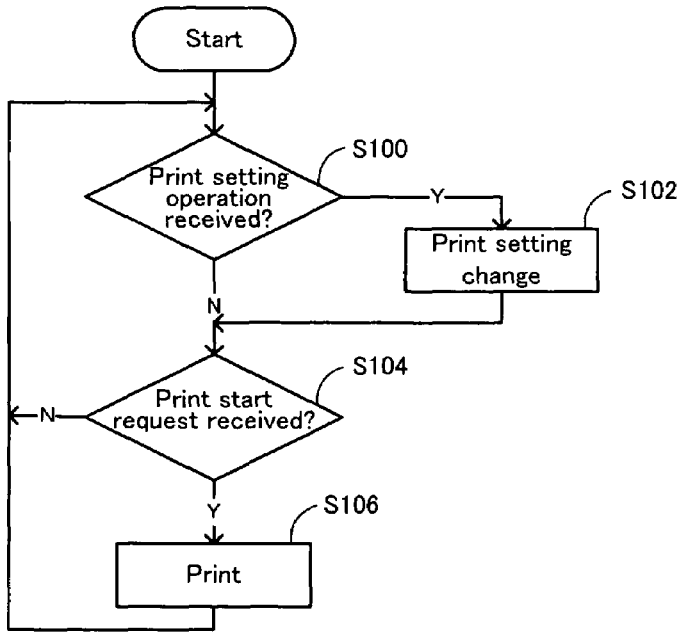
FIG. 4 is a flowchart.

FIG. 4 is a flowchart showing operation of the printer 1. The operation shown in FIG. 4 is started by turning on the power source, and terminated by turning off the power source.

At S100 and S102, the printer 1 receives print setting operations. Specifically, for example, print setting operations are received as follows. The CPU 52 controls the display unit 46, and displays menus 66, 92 shown in FIG. 5 on the screen 22, and in this state the user manipulates the cross key 14 and can select any one of setting items 76, 78, 80, and 82 (S100). The print mode is determined by combination of setting values 68, 70, 72, such as the print size 82, paper type 80, and print quality 78 as setting items. While a specific item is being selected (the selected item is highlighted), the decide key 16 is pressed, and a new menu appears to allow to change any corresponding item of setting values 68, 70, 72, and 74 (S102). The menu 83 shows a list of choices 84, 86 of print quality. While the menu 83 is being displayed, the user presses the cross key 14, and can select either one of choices 84, 86. While a specific choice is being selected, the decide key 16 is pressed, and this choice is the set value (see menu 92). Meanwhile, the CPU 52 can also set the print mode corresponding to the request from external system such as PC 58, digital camera 60 or portable telephone terminal 62. In this case, the CPU 52 functions as the print mode setting unit.

At S104, the printer 1 receives a print start request. Specifically, for example, the print start request is accepted when the print start key 20 is pressed while the menu 66, 92 shown in FIG. 5 are displayed on the screen 22.

When the print start request is accepted, the CPU 52 controls the image processing unit 38 and printing engine 40, and executes printing (S106).

Figure 5:
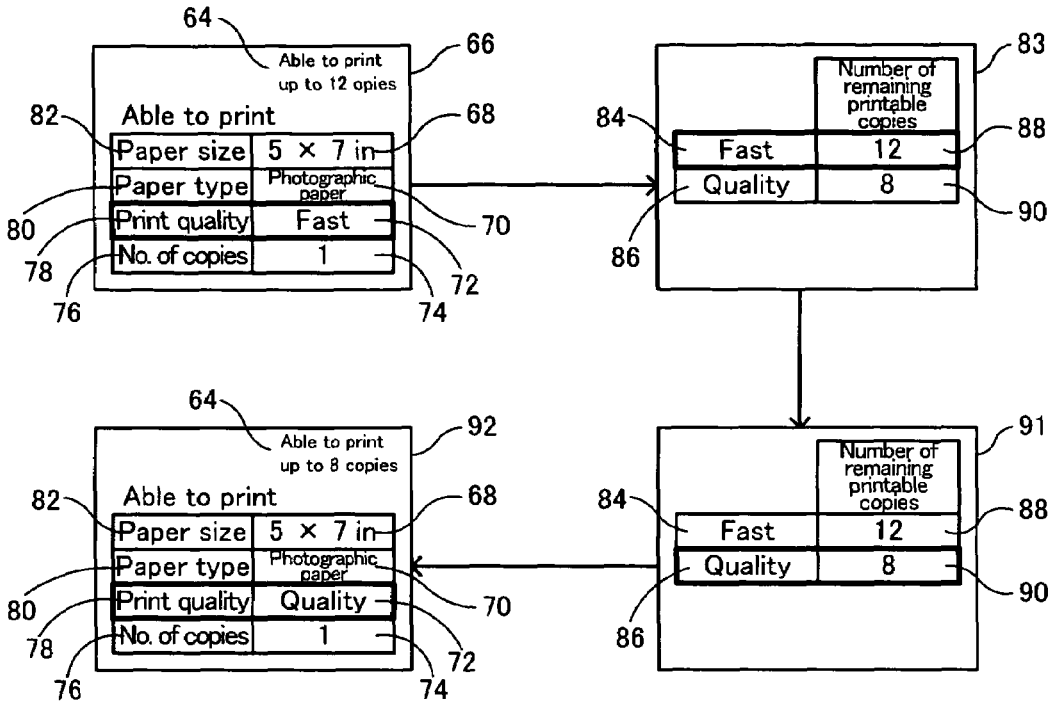
FIG. 5 is a screen transition diagram.

As shown in FIG. 5, the printer 1 displays the number of remaining printable copies 64, 88, and 90 on the menu 66, 83, 91 and 92. The process of displaying the number of remaining printable copies is explained.

Figure 6:
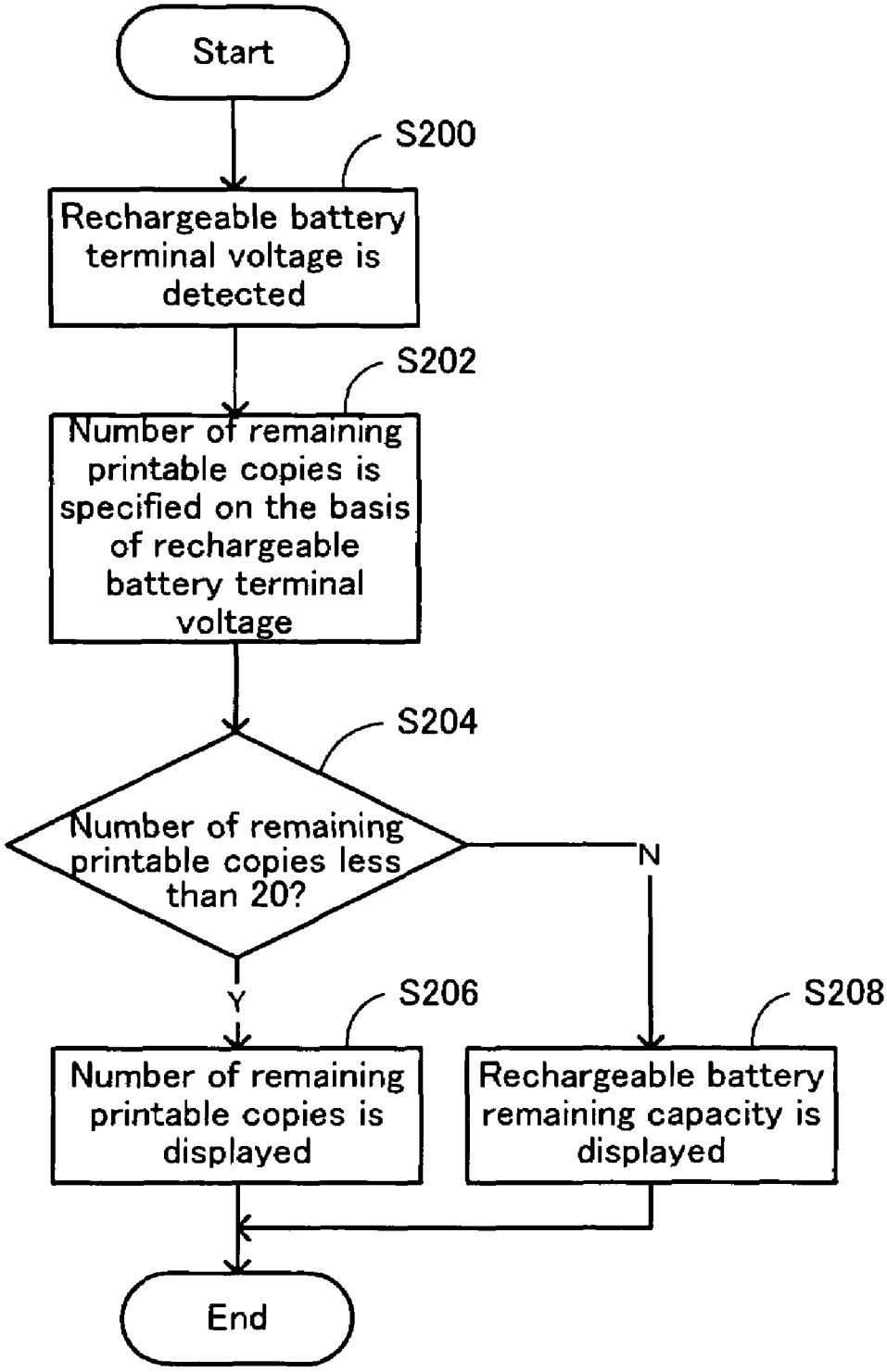
FIG. 6 is a flowchart.

FIG. 6 is a flowchart of displaying process of number of remaining printable copies. In the displaying process of the number of remaining printable copies, the CPU 52 executes the control program, and specifies the number of remaining printable copies on the basis of the terminal voltage of secondary battery 42 obtained from the measuring circuit 44 and displays the number of remaining printable copies in the display unit 46. That is, the CPU 52 functions as the specifying unit that specifies the number of remaining printable copies, and the CPU 52 and display unit 46 function as the output unit that outputs the remaining printable copies.

At S200, the CPU 52 detects the terminal voltage of secondary battery 42 by reading the terminal voltage of secondary battery 42 outputted from the measuring circuit 44.

At S202, the CPU 52 specified the number of remaining printable copies on the basis of the terminal voltage of secondary battery 42. Specifically, for example, the number of remaining printable copies is specified as follows.

Figure 7:
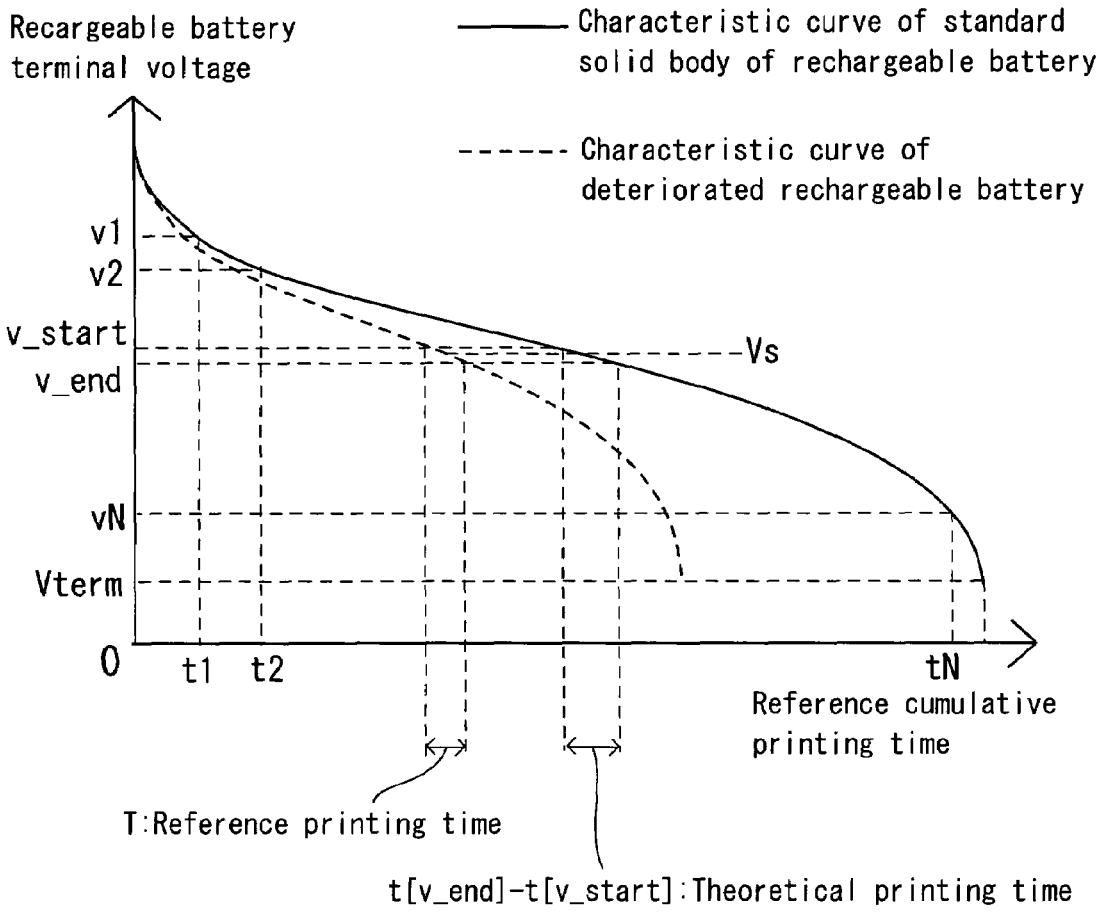
FIG. 7 is a characteristic diagram.

When the printer 1 is driven continuously while a specific load is being applied to the standard solid body of secondary battery 42 in a specific print mode, the remaining capacity of secondary battery 42 decreases along with the lapse of time, and hence the terminal voltage of secondary battery 42 declines. In a specific time after fully charged state, the terminal voltage of secondary battery 42 becomes lower than minimum voltage printable by the printer 1 (Vterm in FIG. 7), and the printer 1 can no longer print. In a specific time after starting printing by using fully charged standard solid body of secondary battery 42, the terminal voltage of secondary battery 42 is measured while printing continuously in specific print mode, the correlation of cumulative printing time as cumulative number of prints (called reference cumulative time) and terminal voltage of standard solid body of secondary battery 42 (called reference terminal voltage) is defined as specific photographic image (see characteristic curve shown by solid line in FIG. 7).

Accordingly, in the specific print mode by using fully charged standard solid body of secondary battery 42, the maximum number of printable pages and reference print time per unit page (T in FIG. 7) can be specified. Therefore, when the mapping information specifying the correlation of reference cumulative printing time and reference terminal voltage, the maximum number of printable pages by using fully charged standard solid body of secondary battery 42, and the reference printing time are preliminarily recorded in a specific print mode, since the reference printing time is constant in a specific print mode, the cumulative printable pages from fully charged state can be specified on the basis of the terminal voltage of secondary battery 42 detected at specific timing during execution of printing in specific print mode, without measuring directly the remaining capacity of secondary battery 42. Further, the number of remaining printable copies at the timing can be specified by subtracting the cumulative printable pages from the maximum number of printable pages. In waiting status, too, if the terminal voltage of secondary battery 42 detected by the CPU 52 at specific timing is the corrected value of measured terminal voltage in consideration of voltage drop during printing, the number of remaining printable copies can be specified in the same method of specifying the number of remaining printable copies in printing status mentioned above.

However, since discharge capacity of secondary battery 42 decreases by repetition of charge and discharge (so-called cycle deterioration), and the number of remaining printable copies must be corrected in consideration of cycle deterioration. In consideration of cycle deterioration, the number of remaining printable copies can be corrected, for example, as follows. When discharge capacity of secondary battery 42 decreases due to cycle deterioration, decline of terminal voltage of secondary battery 42 is accelerated due to the quantity of current discharged by the secondary battery 42. That is, the characteristic curve showing the photographic image of cumulative printing time by using deteriorated secondary battery 42 and measured terminal voltage of secondary battery 42 is compressed in the direction of time axis depending on cycle deterioration from the characteristic curve showing the photographic image of reference cumulative printing time and reference terminal voltage of secondary battery 42 (see characteristic curve indicated by dotted line in FIG. 7). Therefore, the difference between the reference cumulative printing time determined by the mapping information from the terminal voltage of secondary battery 42 (see v_start in FIG. 7) detected upon start of print of unit page, and the reference cumulative printing time by the mapping information from the terminal voltage of secondary battery 42 (see v_end in FIG. 7) detected upon end of print of unit page is calculated (this is called the theoretical printing time), and when the number of remaining printable copies specified without consideration of cycle deterioration is corrected depending on the ratio of the theoretical printing time and the reference printing time (T in FIG. 7) as measured value of printing time per unit page using the standard solid body of secondary battery 42, a correct number of remaining printable copies can be specified in the actually used secondary battery 42. An example of the specific realizing method mentioned above is described specifically below.

Figure 8:
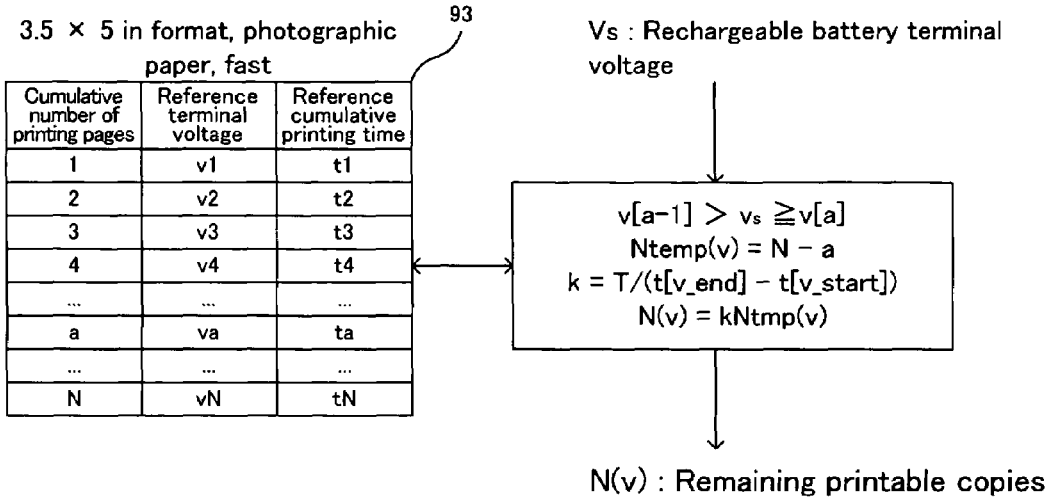
FIG. 8 is an explanatory diagram.

The photographic image specifying the correlation of reference cumulative printing time and reference terminal voltage can be stored in the flash memory 50 as table in each print mode. The mapping information may be defined as function in control program. FIG. 8 shows a table 93 corresponding to a print mode in combination of paper size=3.5×5 in, paper type=photographic paper, and print quality=fast. The table 93 records reference terminal voltage (vn) and reference cumulative printing time (tn) right after printing measured at every print of one page. Herein, the subscript "n" of vn and tn refers to the cumulative print page number at the moment. For example, v1 and t1 are the reference terminal voltage and reference cumulative printing time of first page respectively. After printing every page, meanwhile, the reference terminal voltage and reference cumulative printing time may be measured a plurality of times, and measured results may be recorded in the table 93. The CPU 52 refers to the table 93 when the terminal voltage Vs of rechargeable battery 42 is detected, and specifies the value of "a" satisfying the relation of formula (1). The value of "a" shows the terminal voltage Vs that is the value detected during printing of which page in the period of use of fully charged standard solid body of rechargeable battery 42.

$$V[a-1]>Vs\geqq V[a] \quad \text{formula (1)}$$

When the value of "a" is specified in formula (1), the CPU 52 specifies Ntemp(v) satisfying the relation of formula (2). Ntemp(v) is a correct number of remaining printable copies when the rechargeable battery 42 is a standard solid body (that is, rechargeable battery 42 without cycle deterioration).

$$N\text{temp}(v)=N-a \quad \text{formula (2)}$$

When Ntemp(v) is specified in formula (2), the CPU 52 specifies the value of "k" satisfying the relation of formula (3). As mentioned above, T is the time (reference printing time) required for printing a unit page in the set print mode by using a standard solid body of rechargeable battery 42. The values of t[v_end] and t[v_start] are reference cumulative printing time determined by referring to the table 93, and the reference cumulative printing time corresponding to start of print of the page finished in printing immediately before, and the reference cumulative printing time corresponding to end of print of the page finished in printing immediately before. That is, t[v_end]−t[v_start] is the theoretical printing time per unit page.

$$k=T/(t[v_\text{end}]-t[v_\text{start}]) \quad \text{formula (3)}$$

When the value of "k" is specified in formula (3), the CPU 52 specifies N(v) satisfying formula (4) as the number of remaining printable copies.

$$N(v)=kN\text{temp}(v) \quad \text{formula (4)}$$

This is an explanation of specific example of specifying method of number of remaining printable copies.

At S204 (see FIG. 6), the CPU 52 judges if the specified number of remaining printable copies N(v) is less than specified value (for example, 20) or not.

If the number of remaining printable copies N(v) is less than 20, the CPU 52 controls the display unit 46, and displays the number of remaining printable copies N(v) on the screen 22 (S206). When the number of remaining printable copies N(v) is 20 or more, the CPU 52 specifies the remaining capacity of rechargeable battery 42 on the basis of terminal voltage of rechargeable battery 42, and controls the display unit 46 to display the remaining capacity of rechargeable battery 42 on the screen 22 (S208).

A specific example of display format of number of remaining printable copies is described below.

As shown in FIG. 1, when the number of remaining printable copies is 20 or more, an indicator 100 showing the remaining capacity of rechargeable battery 42 is displayed on the screen 22 in menu 102, 108 capable of receiving print start request. The indicator 100 shows a wider solid region when the remaining capacity of rechargeable battery 42 is more. If the number of remaining printable copies is less than 20, the number of remaining printable copies 64 is displayed in the menu 104, 106, 110 capable of receiving print start request. Since the table or function is defined as mapping information in each print mode as mentioned above, when setting of print mode is changed, the number of remaining printable copies corresponding to the changed print mode can be displayed. Hence the user knows how many more pages can be printed in the presently set print mode.

Further, as shown in FIG. 5, the CPU 52 may control the display unit 46 to display the number of remaining printable copies 88, 90 in the menu 83, 91 for selecting the print mode in every choice 84, 88 for determining the print mode. As a result, the user can select the print mode depending on the number of remaining printable copies.

Figure 9:
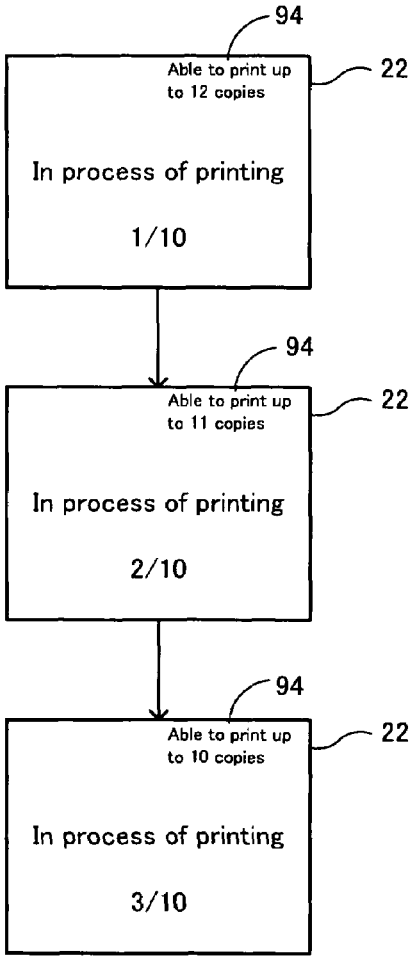
FIG. 9 is a screen transition diagram.

As shown in FIG. 9, moreover, the CPU 52 may detect the terminal voltage of rechargeable battery 42 during printing, and update the number of remaining printable copies depending on the result of detection, after printing every page, and display the updated number of remaining printable copies 94 in the display unit 46. As a result, if a desired number of printing copies is larger than the number of remaining printable copies, the user can request stop of printing during printing, so that waste of ink or paper can be prevented.

The number of remaining printable copies may be displayed either digitally on the screen or graphically by changing the length or area of constituent element (for example, a bar) of screen object corresponding to numerical value, or by voice or LED or other indicator putting out lights sequentially when becoming smaller than specified value.

Second Embodiment

Figure 10:
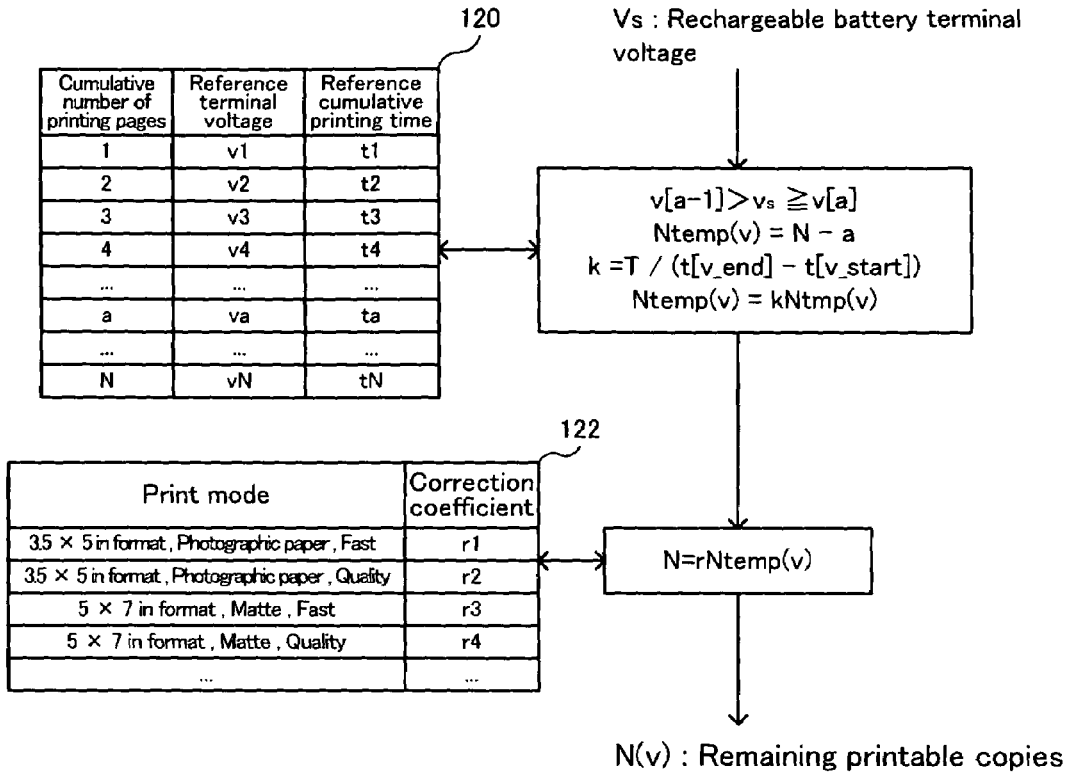
FIG. 10 is an explanatory diagram.

In the second embodiment, other example of the first printing system of the invention is explained. In the first embodiment, one table is defined in each print mode, but in the second embodiment, only one common table is defined for all print modes. As shown in FIG. 10, the CPU 52 refers to the table 120 common to all print modes, and specifies the value corresponding to the number of remaining printable copies N in the first embodiment. In the second embodiment, this value is Ntemp. Further, the CPU 52 refers to a table 122 defining the correction coefficient in every print mode, and specifies the correction coefficient "r" corresponding to the set print mode, and specifies a correct number of remaining printable copies N satisfying formula (5).

$$N=r\text{Ntemp} \quad \text{formula (5)}$$

First Embodiment of Second Printing System

Figure 11:
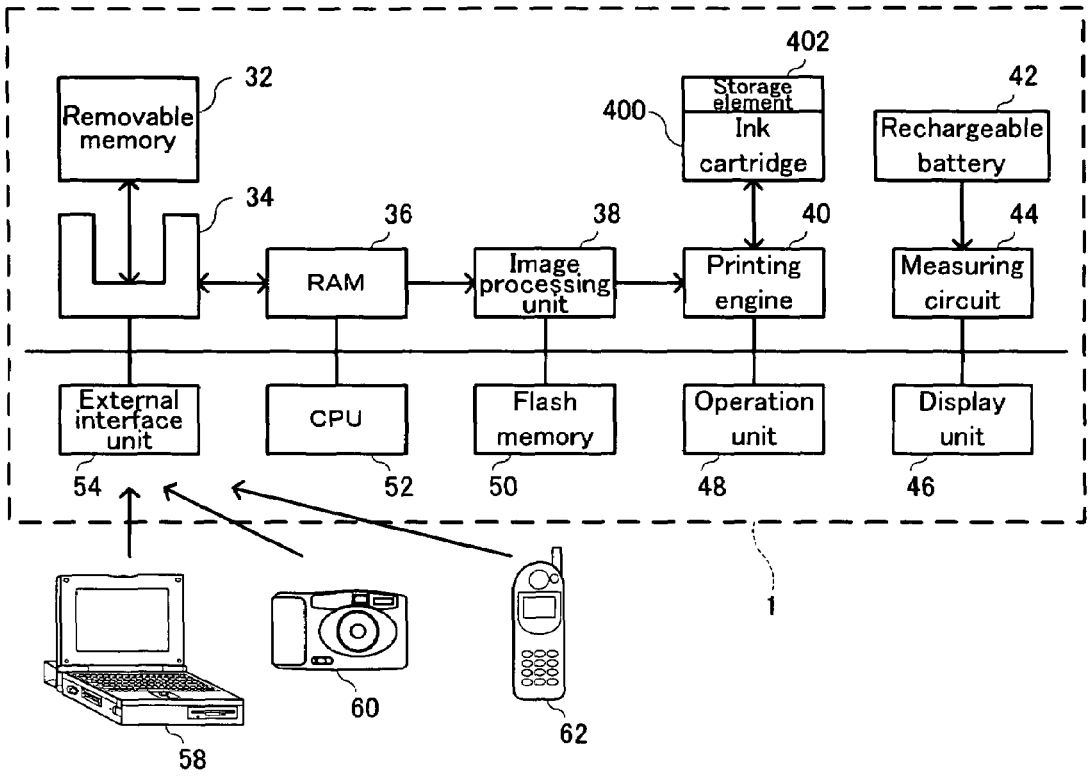
FIG. 11 is a schematic diagram.

FIG. 11 is a block diagram of hardware of printer 1 as first embodiment of second printing system of the invention. Description of same parts as in the first printing system is omitted.

An ink cartridge 400 has a storage element 402. Specifically, the storage element 402 is a nonvolatile memory such as EEPROM, and the storage element 402 stores ink remainder index correlating with the ink remainder or the like. Herein, the ink remainder index as coloring material remainder index decrease as the ink as coloring material is consumed, and it becomes a specific value (for example, 0) when the ink remainder is zero. The ink remainder index is updated depending on the amount of ink spent by the printing engine 40 by every occasion of printing, cleaning of printing head, and flushing of printing head. Specifically, the ink remainder index is updated as follows. The CPU 52 and storage element 402 are electrically connected with the ink cartridge 400 being installed in the printer 1, so that data can be exchanged. The CPU 52 calculates the spent amount of ink on the basis of the total number of ink injections for printing, cleaning of printing head, and flushing of printing head, and the amount of ink spent per injection. The CPU 52 subtracts the amount corresponding to the ink consumption from the ink remainder index before execution of printing or other operation, and overwrites the result on the ink remainder index stored in the storage element 402, and thereby updates the ink remainder index. The storage element 402 may also store other information, such as the color of the ink contained in the ink cartridge 400, the type of ink cartridge 400, version, manufacturer's name, and date of manufacture. The storage element 402 storing the ink remainder index may be also mounted on the main body of the printer 1. Or the ink remainder index may be stored in the flash memory 50.

Figure 12:
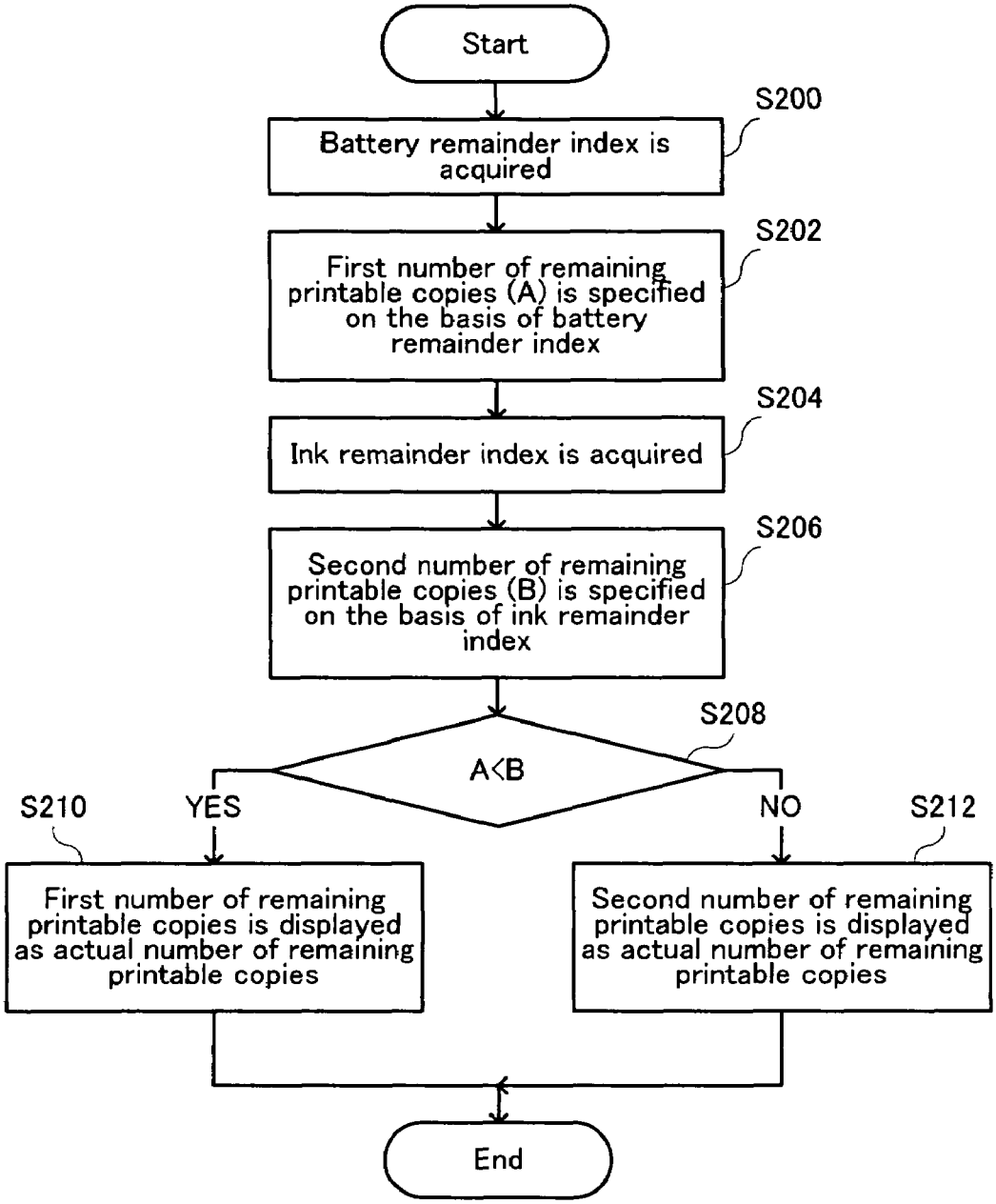
FIG. 12 is a flowchart.

FIG. 12 is a flowchart showing the process of display of actual number of remaining printable copies. The actual number of remaining printable copies is the value showing how many more pages can be printed in the print mode determined by the remaining capacity of rechargeable battery 42 and ink remainder at a specific moment. In the process for displaying the actual number of remaining printable copies, the CPU 52 executes the control program, and specifies a first number of remaining printable copies limited by the remaining capacity of rechargeable battery 42, and specifies a second number of remaining printable copies limited by the ink remainder, and displays either the first number of remaining printable copies or the second number of remaining printable copies, whichever the smaller, as the actual number of remaining printable copies on the screen of the display unit 46. That is, the CPU 52 functions as the first specifying unit that specifies the first number of remaining printable copies and the second specifying unit that specifies the second remaining printable copies, and the CPU 52 and display 46 function as the output unit that outputs the number of remaining printable copies.

At S200, the CPU 52 acquires the battery remainder index. Specifically, the CPU 52 reads the terminal voltage of rechargeable battery 42 outputted from the measuring circuit 44 as the battery remainder index.

At S202, the CPU 52 specifies a first number of remaining printable copies on the basis of the battery remainder index.

At S204, the CPU 52 acquires the ink remainder index. Specifically, the CPU 52 reads the ink remainder index stored in the storage element 402. The printer 1 may have a sensor for measuring the ink remainder of the ink cartridge 400, and the CPU 52 may acquire the result of measuring outputted by the sensor directly as the ink remainder index.

At S206, the CPU 52 specifies a second number of remaining printable copies on the basis of ink remainder index. Specifically, the CPU 52 specifies the second number of remaining printable copies on the basis of ink remainder index and reference ink consumption index. The reference ink consumption index is an index correlating with the quantity of ink spent for printing one page in the set print mode. The reference ink consumption index is stored in the flash memory 50 in each print mode. For example, the CPU 52 calculates the quotient of ink remainder index by reference ink consumption index, and specifies the second number of remaining printable copies.

At S208, the CPU 52 compares the first number of remaining printable copies and the second number of remaining printable copies. Further, the CPU 52 displays either the first number of remaining printable copies or the second number of remaining printable copies, whichever the smaller, in the display unit 46 as the actual number of remaining printable copies (S210, S212).

A specific example of display format of actual number of remaining printable copies is described.

Figure 13:
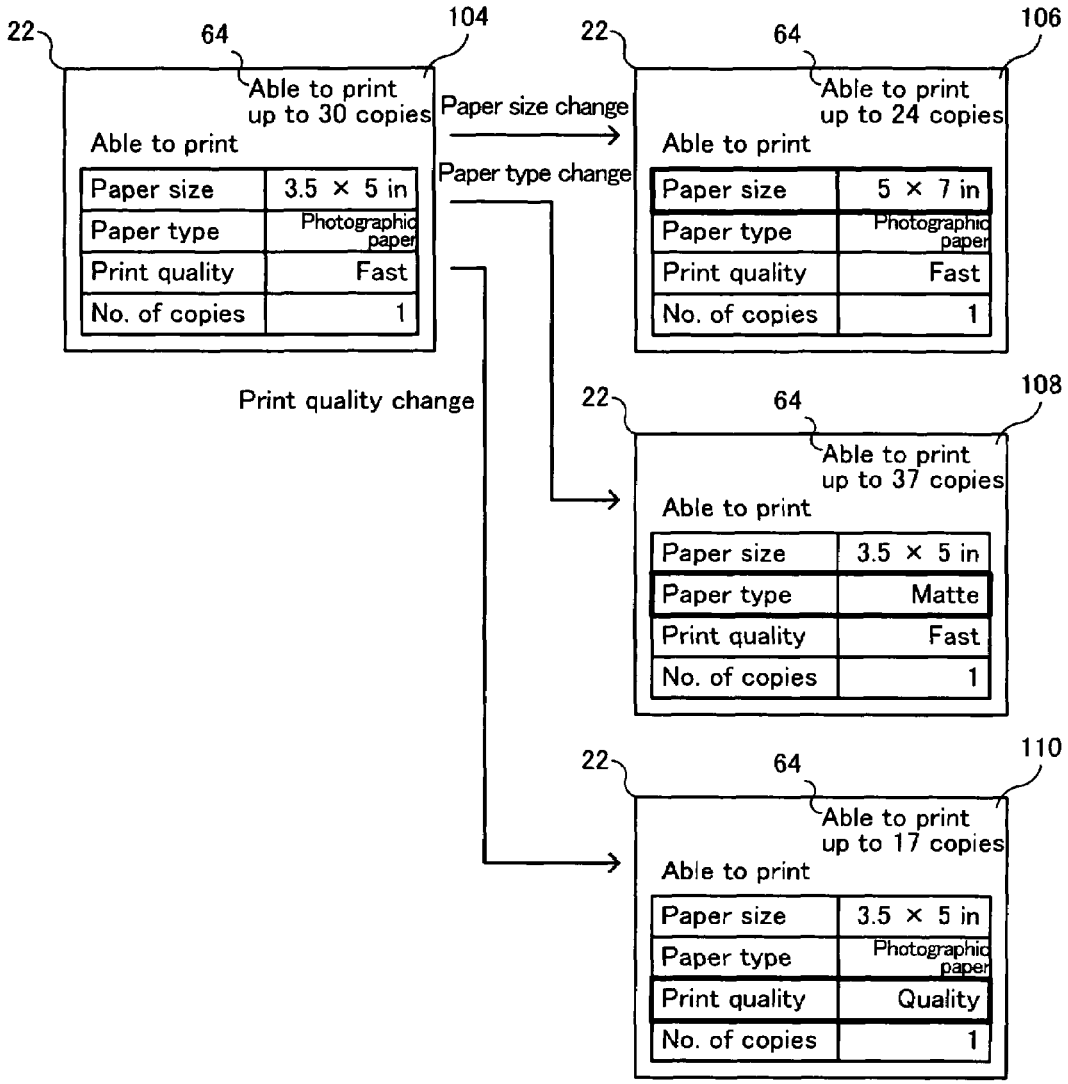
FIG. 13 is a screen transition diagram.

As shown in FIG. 13, the actual number of remaining printable copies 64 is displayed in the menu 104, 106, 108, 110 capable of accepting print start request. As mentioned above, since the reference cumulative printing time and reference ink consumption index in each print mode are stored in the flash memory 50 and the table or function is defined in each print mode, when setting of print mode is changed, the actual number of remaining printable copies depending on the changed print mode can be displayed. As a result, the user knows how many more pages can be printed in this set print mode.

Or, as shown in FIG. 5, the CPU 52 may control the display unit 46, and display the actual number of remaining printable copies 88, 90 in the menu 83, 91 for selecting the print mode, in each one of choices 84, 86 for determining the print mode. As a result, the user can select the print mode depending on the actual number of remaining printable copies.

Further, as shown in FIG. 9, the CPU 52 may also detect the terminal voltage of rechargeable battery 42, and update the actual number of remaining printable copies every time printing one page depending on the result of detection, and thereby display the updated actual number of remaining printable copies 94 in the display unit 46. As a result, if a desired number of printing copies is larger than the number of remaining printable copies, the user can request stop of printing during printing, so that waste of ink or paper can be prevented.

The actual number of remaining printable copies may be displayed either digitally on the screen or graphically by changing the length or area of constituent element (for example, a bar) of screen object corresponding to numerical value, or by voice or LED or other indicator putting out lights sequentially when becoming smaller than specified value.

Figure 14:
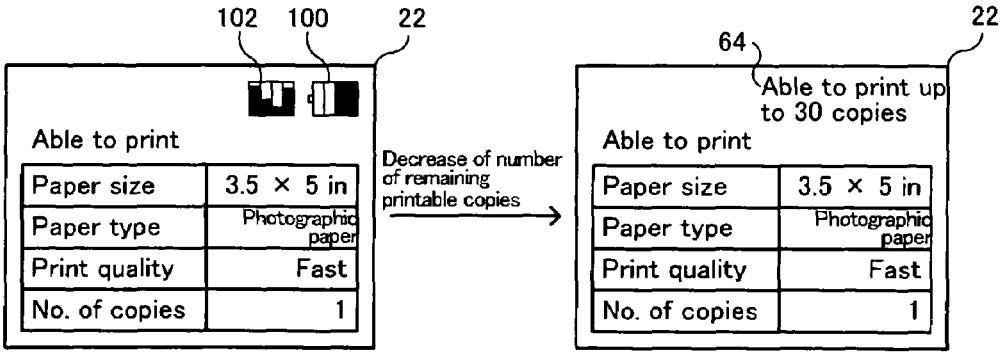
FIG. 14 is a screen transition diagram.

Or, as shown in FIG. 14, if the actual number of remaining printable copies is larger than a specified number, both indicator 100 showing the remaining capacity of rechargeable battery 42 and indicator 102 showing the ink remainder are displayed on the screen 22, and if the actual number of remaining printable copies is less than a specified number (for example, 30), the actual number of remaining printable copies 64 may be displayed on the screen 22. The indicator 100 becomes narrower in the solid region as the remaining capacity of the rechargeable battery 42 is smaller, and the indicator 102 becomes narrower in the solid region corresponding to each color as the ink remainder becomes smaller.

Second Embodiment of Second Printing System

Figure 15:
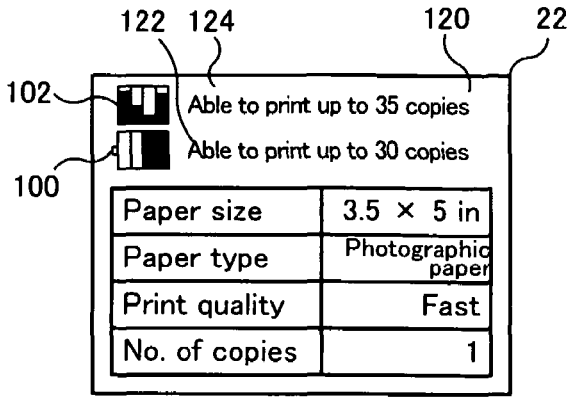
FIG. 15 is an explanatory diagram.

In the first embodiment of second printing system, either the first number of remaining printable copies or the second number of remaining printable copies, whichever the smaller, is displayed in the display unit 46, but in the second embodiment of second printing system of the invention, both the first number of remaining printable copies and second number of remaining printable copies are displayed on the screen 22. For example, as shown in FIG. 15, the CPU 52 displays both first number of remaining printable copies 122 and second number of remaining printable copies 124 in the menu 120. The menu 120 shows the indicator 100 at the left side of first number of remaining printable copies 122, and indicator 102 at the left side of second number of remaining printable copies 124. Hence the user can correctly distinguish the first number of remaining printable copies limited by the remaining capacity of rechargeable battery 42 and the second number of remaining printable copies limited by the ink remainder, and can thereby recognize the actual number of remaining printable copies either the smaller one of first number of remaining printable copies and second number of remaining printable copies.

As signals for distinguishing the first number of remaining printable copies and second number of remaining printable copies, indicator 100 and indicator 102 are shown, but these signals may be either marks or characters not changing depending on the remaining capacity of rechargeable battery or ink remainder.

Besides, the CPU 52 may indicate either smaller one of first number of remaining printable copies and second number of remaining printable copies, that is, the actual number of remaining printable copies by flickering the display, or by displaying a distinguishable color from other screen components, or by displaying larger either the greater one of first number of remaining printable copies and second number of remaining printable copies. Hence, the user knows either the smaller one of first number of remaining printable copies and second number of remaining printable copies as the actual number of remaining printable copies.

Third Embodiment of Second Printing System

Figure 16:
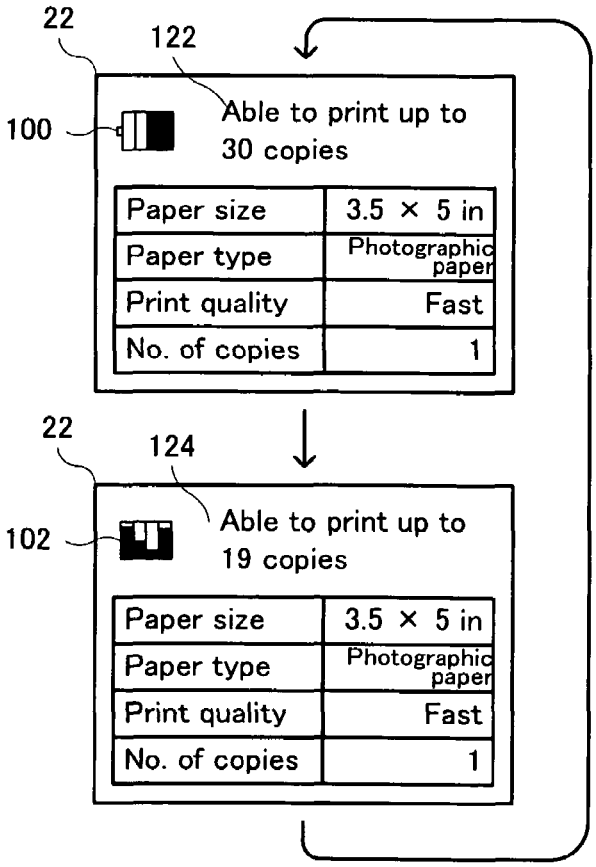
FIG. 16 is a screen transition diagram.

In the second embodiment of second printing system, the first number of remaining printable copies and second number of remaining printable copies are displayed in one menu 120 (see FIG. 15), but in the third embodiment of second printing system of the invention, the printer 1 displays the first number of remaining printable copies and second number of remaining printable copies alternately on the screen 22. Specifically, as shown in FIG. 16, the CPU 52 displays first number of remaining printable copies 122 and second number of remaining printable copies 124 alternately in the display unit 46. As a result, the display region for showing the actual number of remaining printable copies is saved, and both first number of remaining printable copies and second number of remaining printable copies can be displayed in the printer 1 having the display unit 46 of small screen size, so that the actual number of remaining printable copies can be shown to the user.

First Embodiment of Third Printing System

Figure 17:
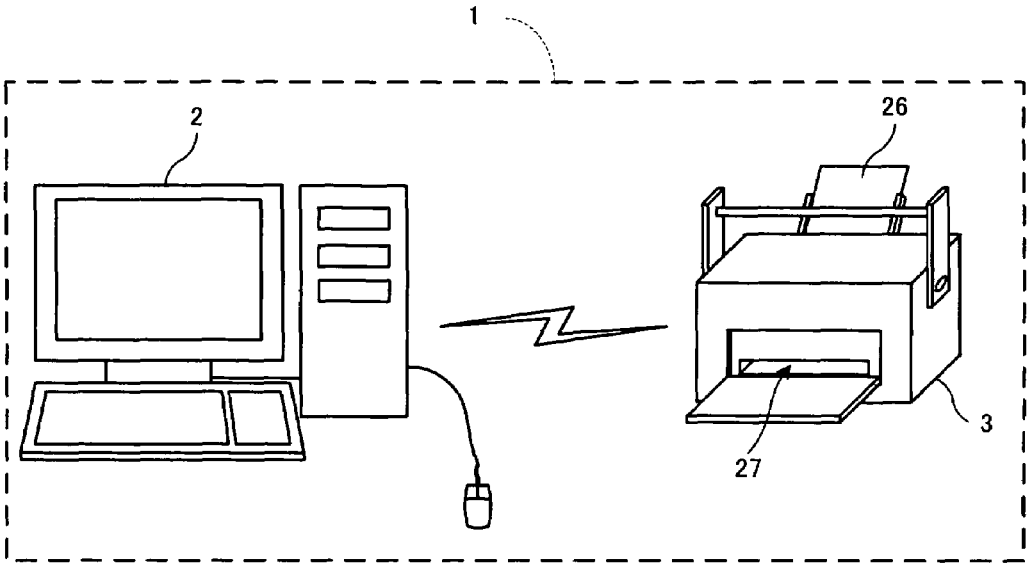
FIG. 17 is a schematic diagram.

FIG. 17 is a schematic diagram of printing system 1 in first embodiment of third printing system of the invention. The printing system 1 in the first embodiment is composed of a personal computer (PC) 2 as print control device and a printer 3.

To begin with, the construction of PC 2 is explained.

Figure 18:
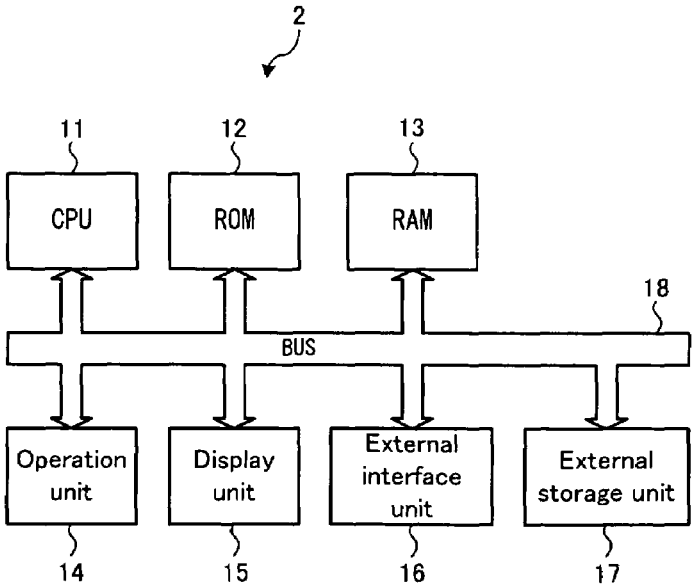
FIG. 18 is a block diagram.

FIG. 18 is a block diagram of hardware of PC 2. The PC 2 includes CPU 11, ROM 12, RAM 13, operation unit 14, display unit 15, external interface 16, and external storage unit 17, and these components are mutually connected by bus 18. The operation unit 14 as print mode setting unit includes mouse, keyboard and others. A display unit 15 as a warning unit and a setting unit that sets print mode is composed of CRT, LCD and other display or display controller. An external storage unit 17 is composed of hard disk and hard disk controller, and stores operating system (OS), print application program, printer driver for printer 3, and other various programs and data. The printer driver for the printer 3 corresponds to the print control program mentioned in the claims. The CPU 11 controls the entire PC 2 by executing the program stored in the ROM 12, external storage unit 17 or the like. The CPU 11 also executes the printer driver and functions as an acquisition unit that acquires a total number of pages to be printed, an acquisition unit that acquires battery remainder index, a specifying unit that specifies a number of remaining printable copies, a warning unit, a setting unit that sets print mode, and an acquisition unit that acquires coloring material remainder index. The ROM 12 is a memory preliminarily storing various programs and data, and the RAM 13 is a memory for storing various programs and data temporarily. These programs and data may be also used by downloading from a specified server through the communication network, or may be read from computer readable recording medium such as removable memory. The external interface unit 16 as the acquisition unit that acquires battery remainder index and the acquisition unit that acquires coloring material remainder index includes USB controller and USB connector for communicating with the printer 3, digital camera, portable telephone terminal or other external systems. The external interface 16 may also include IEEE1394, IrDA (infrared data association), Bluetooth or other interface.

The structure of the printer 3 is described.

Figure 19:
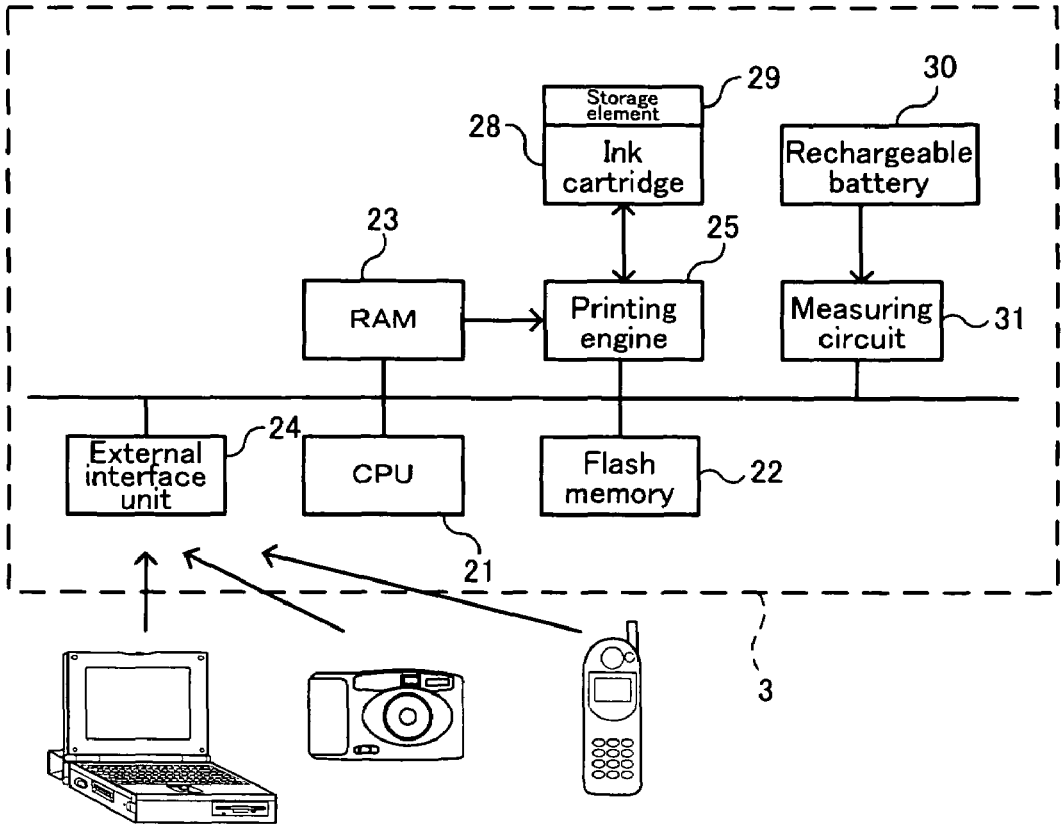
FIG. 19 is a block diagram.

FIG. 19 is a block diagram of hardware of printer 3.

The CPU 21 as coloring material remainder acquisition unit controls the parts of the printer 3 by executing the control program stored in the flash memory 22. The program may be also stored in the flash memory 22 from computer readable recording medium such as removable memory, or may be stored in the flash memory 22 from a remote server by way of network.

The RAM 23 is a volatile memory for temporarily storing control programs and data to be processed by control programs. The RAM 23 stores the data acquired, for example, by the external interface unit 24 from the PC 2, digital camera, or portable telephone terminal.

The external interface unit 24 as the acquisition unit that acquires battery remainder index and the acquisition unit that acquires coloring material remainder index includes USB controller and USB connector for communicating with the PC 2, digital camera, portable telephone terminal or other external systems. The external interface 24 may also include IEEE1394, IrDA, Bluetooth or other interface.

A printing engine 25 as printing unit includes a recording head for forming an image on paper 26 (see FIG. 17) as printing medium by ink jet system same as in the first printing system, a drive unit for moving the recording head reciprocally, a paper feed unit and others.

The ink cartridge 28 has a storage element 29 same as in the second printing system.

The battery is the rechargeable battery 30, such as lithium ion rechargeable battery, nickel cadmium rechargeable battery, nickel hydrogen rechargeable battery, or lithium polymer rechargeable battery same as in the first printing system. The rechargeable battery 30 supplies electric power to parts of the printer 3. The battery may be also alkaline battery, manganese battery, other non rechargeable battery, or fuel cell.

A measuring circuit 31 is an acquisition unit that acquires battery remainder index, and is an analog-digital circuit for measuring the terminal voltage of the rechargeable battery 30 as the battery remainder index same as in the first printing system.

The print application program and printer driver are described below.

Figure 20:
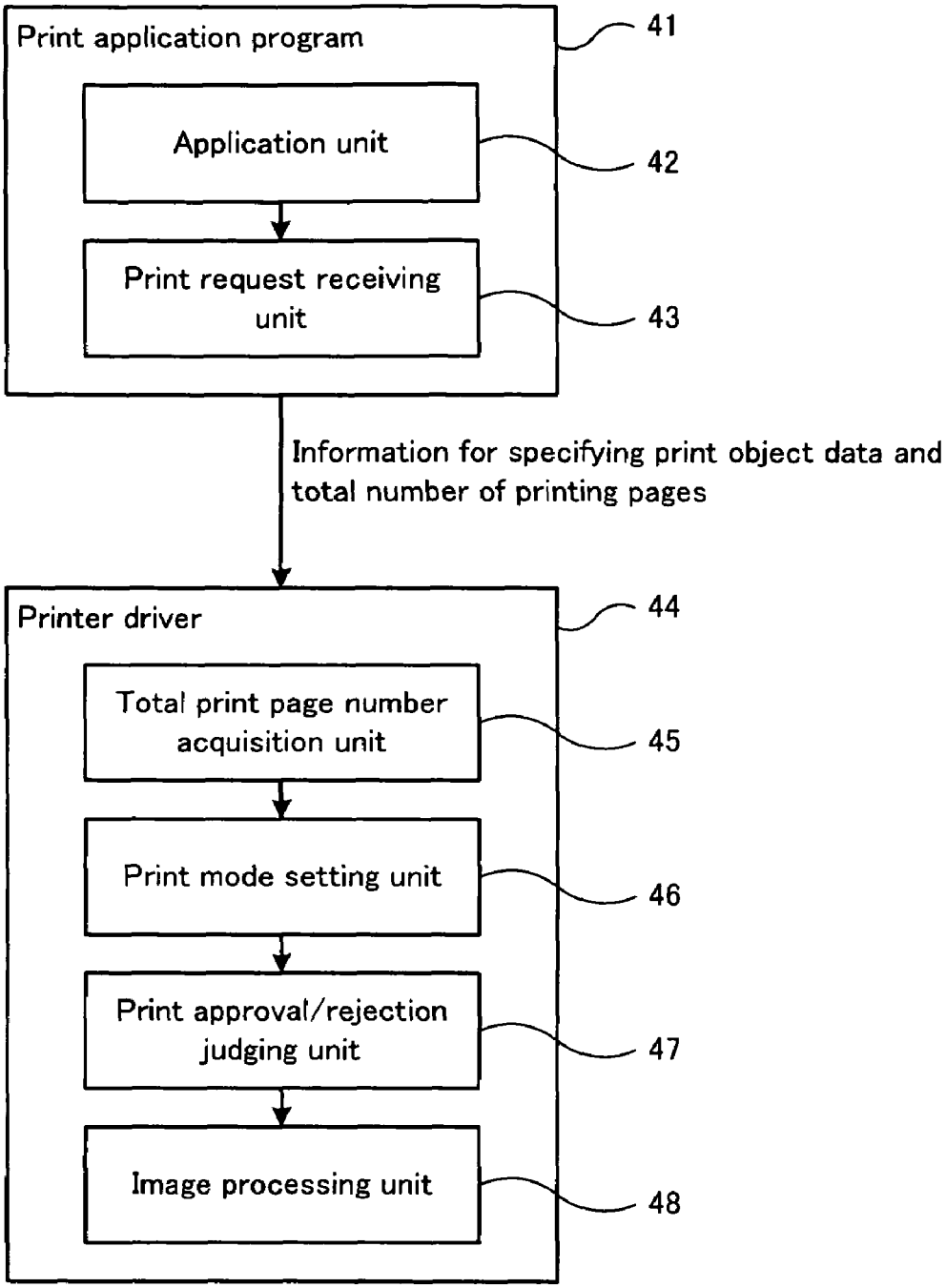
FIG. 20 is a block diagram.

FIG. 20 is a block diagram of logical construction of print application program and printer driver.

The print application program 41 is specifically, for example, retouch software, word processor, tabulation software or the like. The print application program 41 includes an application unit 42 for causing the print application program 41 to execute own functions such as retouch or editing, and a print request accepting unit 43 for accepting instruction of printing page and number of printing copies. The print request accepting unit 43 displays a print screen 52 (see FIG. 21) for accepting instruction of printing page and number of printing copies. The print request accepting unit 43, when receiving input of print start request, outputs the information for specifying the pages to be printed and the total number of printing pages to the printer driver 44, and requests printing. The total number of printing pages is not the number corresponding to number of pages per copy, but the number corresponding to the product of the number of pages per copy and the number of printing copies. The information for specifying the total number of printing pages is specifically the number of pages to be printed, that is, the number of pages per copy and the number of printing copies.

The printer driver 44 includes total print page number acquisition unit 45, print mode setting unit 46, print approval/rejection judging unit 47, and image processing unit 48.

The total print page number acquisition unit 45 acquires information for specifying the total number of printing pages from the print request accepting unit 43. The total print page number acquisition unit 45, after acquiring the information for specifying the total number of printing pages, that is, the number of pages per copy and number of printing copies, calculates their product, and acquires the total number of printing pages. The total print page number acquisition unit 45 may also acquire the total number of printing pages directly as the information for specifying the total number of printing pages.

Figure 22:
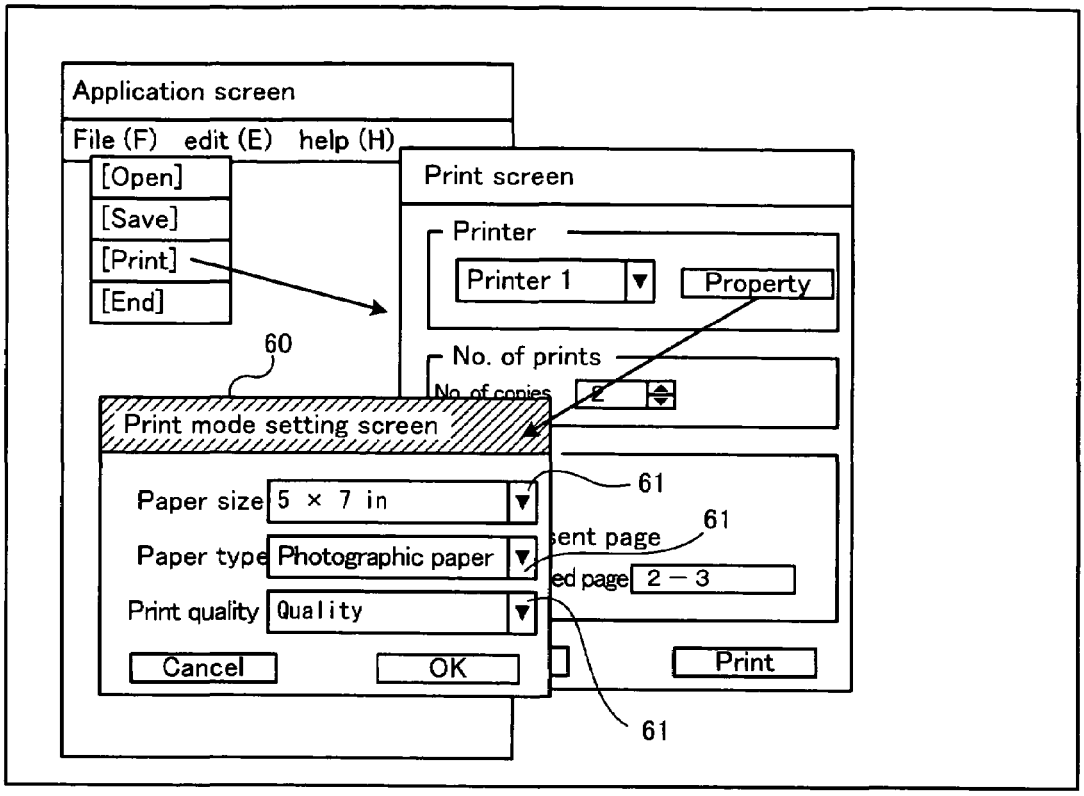
FIG. 22 is a schematic diagram.

The print mode setting unit 46 accepts setting of print mode by displaying the print mode setting screen 60 (see FIG. 22).

The print approval/rejection judging unit 47 judges whether or not to print, and if rejected, a warning message is displayed and print is stopped. More specifically, the print approval/rejection judging unit 47 first acquires the terminal voltage of rechargeable battery 30 form the printer 3 as battery remainder index, and specifies the first number of remaining printable copies on the basis of the acquired battery remainder index and the set print mode. Next, the print approval/rejection judging unit 47 acquires the ink remainder index from the printer 3, and specifies the second number of remaining printable copies on the basis of the acquired ink remainder index and the set print mode. The print approval/rejection judging unit 47 then specifies either the first number of remaining printable copies or the second number of remaining printable copies, whichever the smaller, as the number of remaining printable copies, and judges that print is accepted when the specified number of remaining printable copies is more than the total number of printing pages acquired from the total print page number acquisition unit 45. If the number of remaining printable copies is less than the total number of printing pages, the print approval/rejection judging unit 47 judges print is rejected, and displays a warning messages and stops printing.

The image processing unit 48 processes the pages to be printed by executing gamma correction, sharpness correction, resolution conversion to print resolution, and plate dividing for converting the image to be printed defined by color space such as sRGB into color space corresponding to ink colors such as CMY, and also binary coding, interlace processing, and outputs to the printer 3.

The screen displayed by print application program 41 and printer driver 44 is described below.

Figure 21:
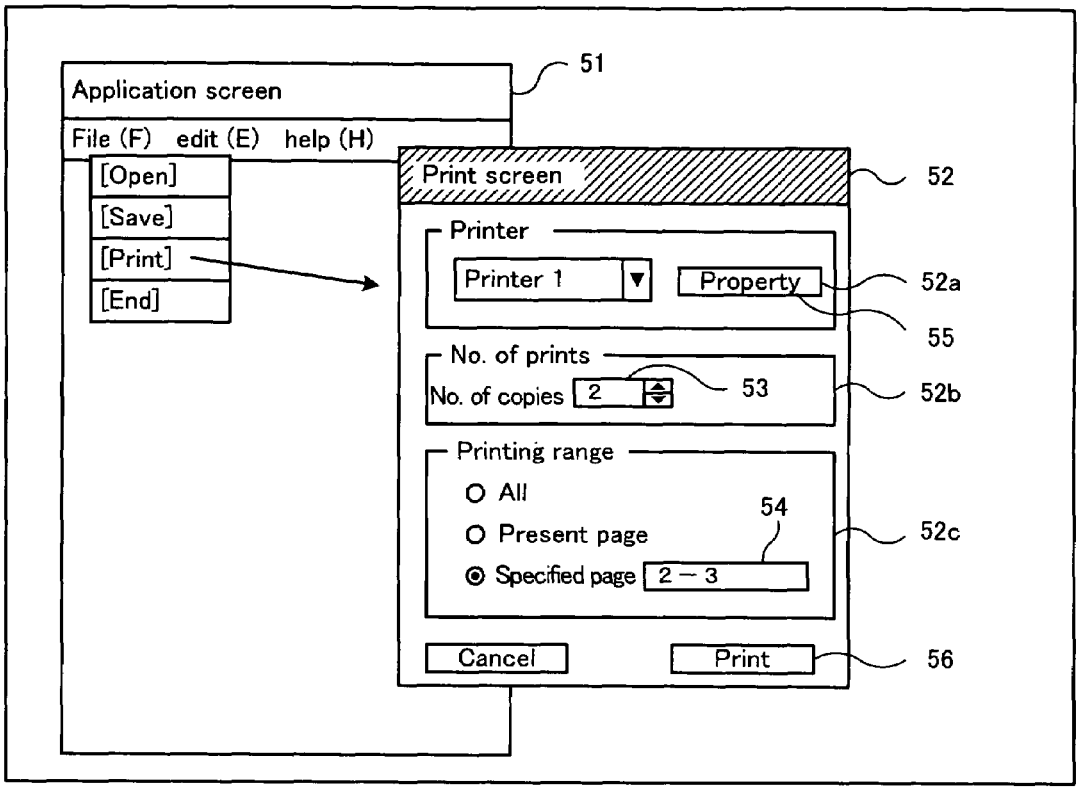
FIG. 21 is a schematic diagram.

FIG. 21 is a schematic diagram showing application screen and print screen displayed by execution of print application program 41 by CPU 11. When printing, the user selects [print] from the menu of application screen 51. When [print] is selected, the print screen 52 is displayed for setting the printing condition. On the print screen 52, printer column 52*a* is a field for selecting the printer to be used. Print copy number column 52*b* is a field for specifying the number of copies to be printed. For example, when [2] is inputted in the input field 53, the page specified to be printed at this time is printed in two copies. Print range column 52*c* is a field for specifying the pages to be printed, and any one of [all], [present page], and [specified page] can be selected. When [all] is selected, all pages in the data being edited are to be printed. When [present page] is selected, only the active page at the moment is printed. When [specified page] is selected, the pages to be printed can be specified in page unit. By specifying the pages to be printed in print range column 52*c*, the number of pages per copy is determined. A property button 55 is a button for setting a specific print mode for the selected printer. When the property button 55 is pressed, the printer driver 44 corresponding to the selected printer is called, and the print mode setting screen is displayed for setting the print mode by the called printer driver 44.

FIG. 22 is a schematic diagram showing an example of print mode setting screen 60. The print mode setting screen 60 in the first embodiment includes setting items for paper size, paper type, and print quality. When each button 61 of setting items is pressed, choices are displayed by pulldown menu, and the user can select a desired choice, and a specific printing condition can be specified. The print mode is specified by combination of printing conditions selected in each setting item.

A print button 56 on the print screen 52 shown in FIG. 21 is a button for inputting a print start request. When the print button 56 is pressed, printing of desired pages is requested from the print application program 41 to the printer driver 44. The called printer driver 44 judges whether or not to print, and if allowed, the printer is controlled to start printing. If rejected, the printer driver 44 displays a warning screen and stops printing.

Figure 23:
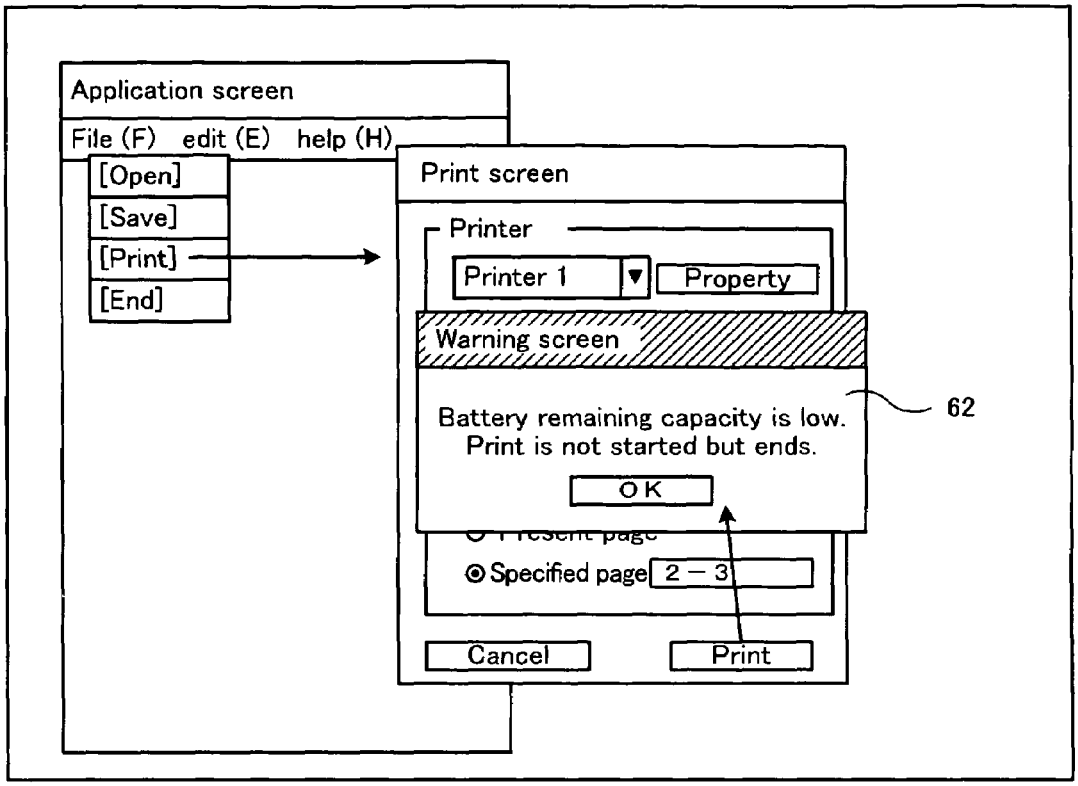
FIG. 23 is a schematic diagram.

FIG. 23 is a schematic diagram showing a warning screen. If the reason of print rejection is shortage of battery remaining capacity, the printer driver 44 displays a warning message on the warning screen 62, such as "Battery remaining capacity is low. Print is not started and ends." as shown in FIG. 23. If the reason of print rejection is shortage of ink remainder, the printer driver 44 warns "Ink remainder is low. Print is not started and ends." The user knows that printing is stopped on the way. If warning message is not shown, the user knows printing is completed without stopping on the way. Since the warning message is accompanied by the reason, the user knows why and can take corrective action.

Processing flow of printing system 1 is described below.

Figure 24:
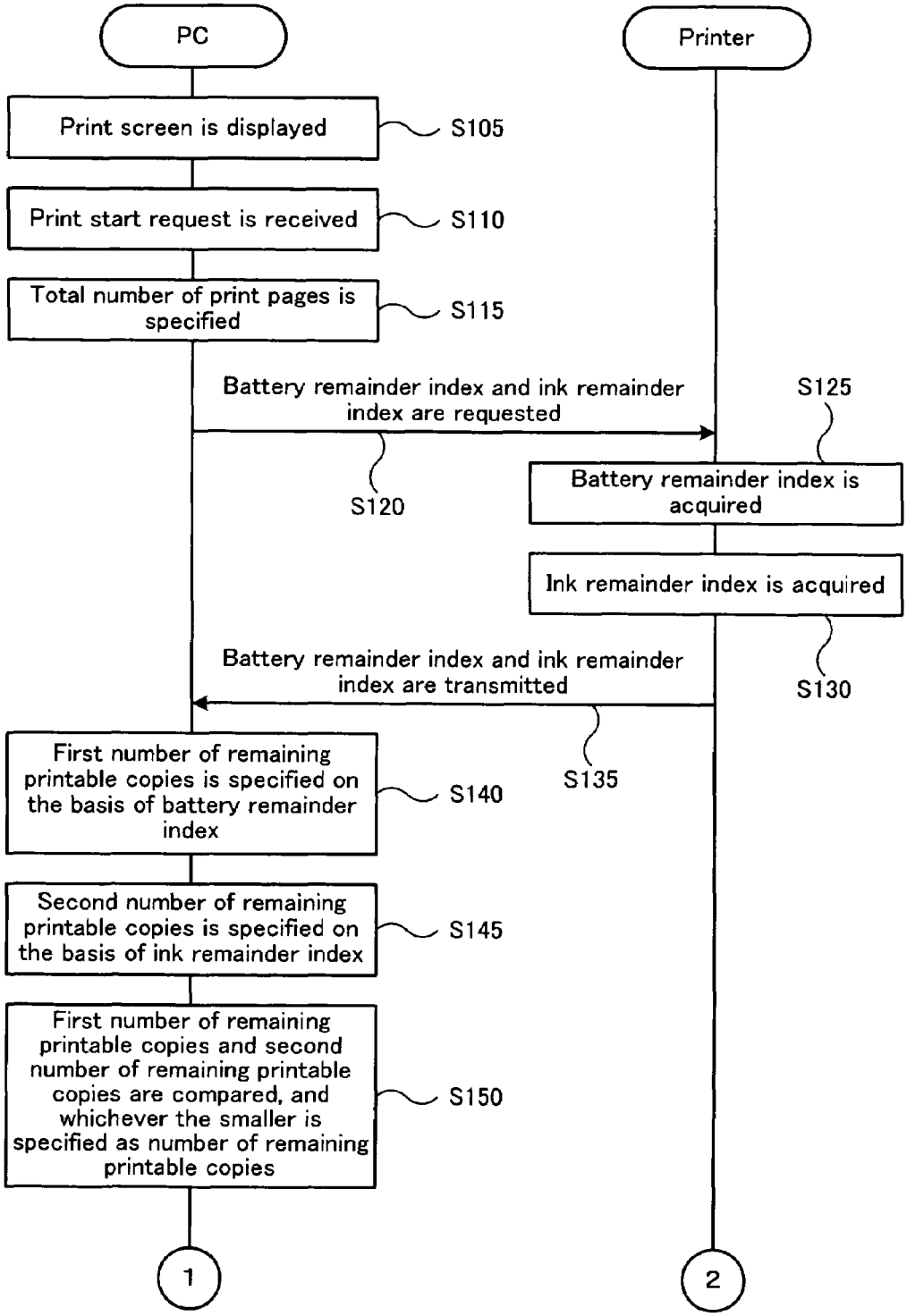
FIG. 24 is a sequence chart.
Figure 25:
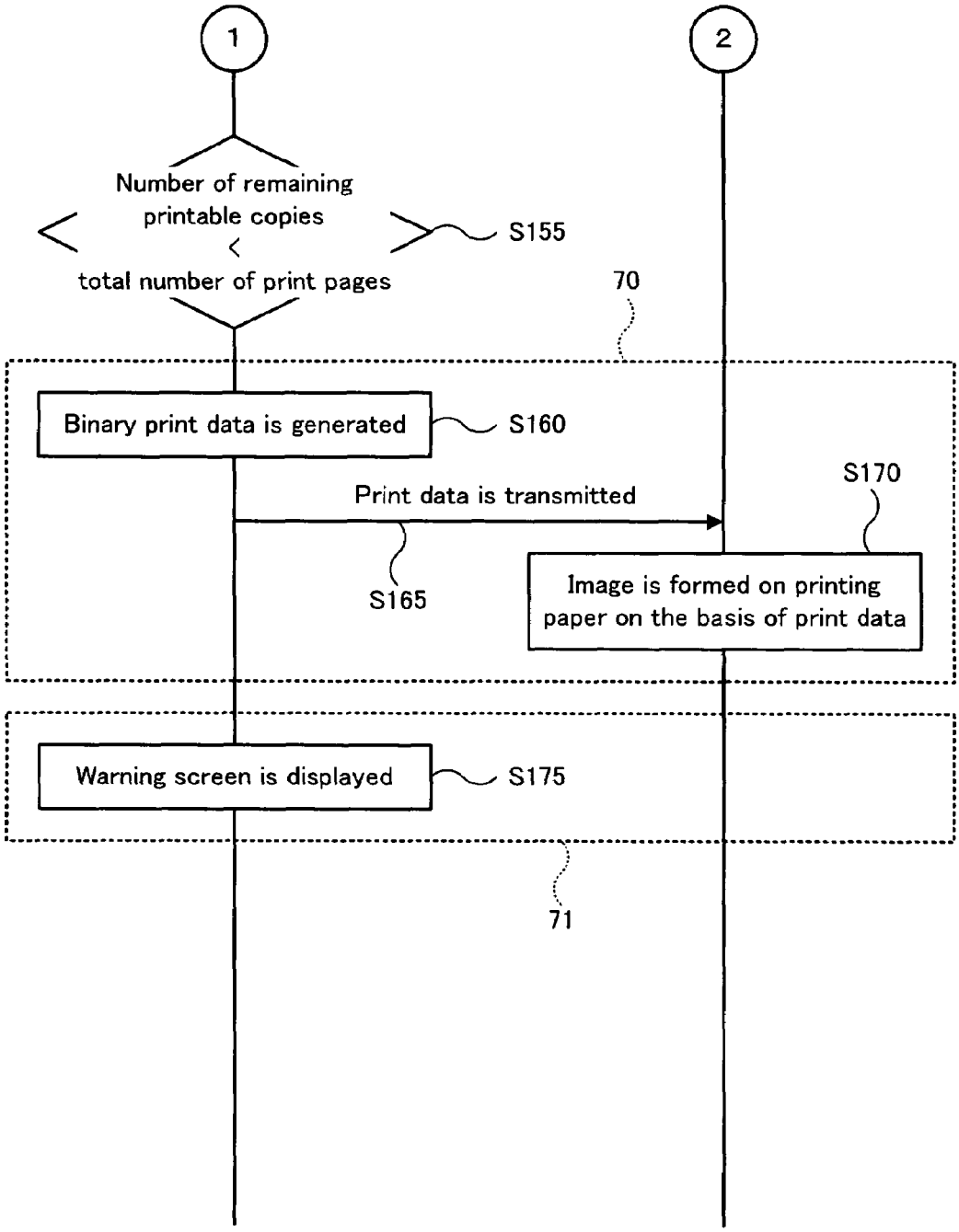
FIG. 25 is a sequence chart.

FIG. 24 and FIG. 25 are sequence charts showing processing flow of printing system 1. This process is started when [print] is selected on the menu of print application program 41.

At S105, the CPU 11 for executing the print application program 41 displays the print screen 52 as shown in FIG. 21.

At S110, the CPU 11 receives a print start request. Specifically, for example, when the print button 56 is pressed on the print screen 52, the print start request is accepted. When the CPU 11 receives the print start request, the desired pages to be printed, the number of pages per copy, number of printing copies, and print mode specified on the print screen 52 are stored in the RAM 13, and the print application program 41 is set in waiting status, and the printer driver 44 is executed. On the print screen 52, suppose the printer 3 is selected as the printer.

At S115, the CPU 11 for executing the printer driver 44 reads out the number of pages per copy and number of printing copies from the RAM 13, and specifies the total number of printing pages.

At S120, the CPU 11 requests transmission of battery remainder index and ink remainder index to the printer 3.

At S125, the CPU 21 of the printer 3 acquires the battery remainder index. Specifically, the CPU 21 reads the terminal voltage of rechargeable battery 30 issued from the measuring circuit 31 as battery remainder index.

At S130, the CPU 21 acquires the ink remainder index. Specifically, the CPU 21 reads the ink remainder index stored in the storage element 29. The printer 3 may have a sensor unit for measuring the ink remainder in the ink cartridge 28, and the CPU 21 may acquire the measuring result outputted from the sensor directly as the ink remainder index.

At S135, the CPU 21 transmits the battery remainder index and ink remainder index to the PC 2.

At S140, the CPU 11 of the PC 2 specifies the first number of remaining printable copies on the basis of the battery remainder index of rechargeable battery 30 same as in the first embodiment.

At S145, the CPU 11 specifies the second number of remaining printable copies on the basis of the ink remainder index. Specifically, the CPU 11 specifies the second number of remaining printable copies on the basis of ink remainder index and reference ink consumption index. The reference ink consumption index is an index correlating with the quantity of ink spent for printing one page in the set print mode. The reference ink consumption index is stored in the flash memory in each print mode. For example, the CPU 11 calculates the quotient of ink remainder index by reference ink consumption index, and specifies the second number of remaining printable copies.

At S150, the CPU 11 compares the first number of remaining printable copies and second number of remaining printable copies. Further, the CPU 11 specifies either the first number of remaining printable copies or the second number of remaining printable copies, whichever the smaller, as the number of remaining printable copies.

At S155, the number of remaining printable copies and the total number of printing pages are compared. When the number of remaining printable copies is more than the total number of printing pages, the operation advances to the process enclosed by broken line 70, and when the number of remaining printable copies is less than the total number of printing pages, the operation advances to the process enclosed by broken line 71.

At S160, the CPU 11 processes the desired pages according to the selected print mode, and generates binary print data.

At S165, the CPU 11 transmits the generated print data to the printer 3, and instructs printing by the specified number of copies.

At S170, the CPU 21 of the printer 3 controls the parts, and prints images on the printing paper according to the received print data. This operation is repeated by the number of copies instructed.

At S175, the CPU 11 displays a warning screen 62 as shown in FIG. 23. When the warning screen 62 is displayed, the user takes a corrective action, for example, by charging the rechargeable battery 30, exchanging the ink cartridge 28, reducing the number of copies, or changing the print mode, and presses the print button 56 again, so that printing can be finished to the end without stopping on the way.

According to the printing system 1, if the number of remaining printable copies specified on the basis of the battery remainder index correlating with the remaining capacity of rechargeable battery 30 is less than the total number of printing pages, since the warning screen 62 is displayed before starting printing, and the user knows whether the rechargeable battery 30 spent out or not during printing before starting printing. Therefore, when shortage of rechargeable battery 30 during printing is known by warning, by replacing the rechargeable battery 30, battery shortage during printing can be prevented. If warning is not displayed, the user knows that the rechargeable battery 30 is enough in capacity during printing, and can start operation safety without fear of battery shortage during printing.

According to the printing system 1, either the first number of remaining printable copies specified on the basis of battery remainder index or the second number of remaining printable copies specified on the basis of ink remainder index, whichever the smaller, is specified as the number of remaining printable copies, and trouble by ink shortage can be also prevented.

According to the printing system 1, as mentioned above, since the print mode is reflected in the first number of remaining printable copies and second number of remaining printable copies, a more accurate number of remaining printable copies is obtained.

In the first embodiment, warning is made by warning message display, but warning by voice or by LED is also possible.

Second Embodiment of Third Printing System

In the second embodiment of third printing system, print approval or rejection is judged when any one of the desired pages to be printed, number of print copies, or print mode is changed, not when the print button 56 is pressed.

Figure 26:
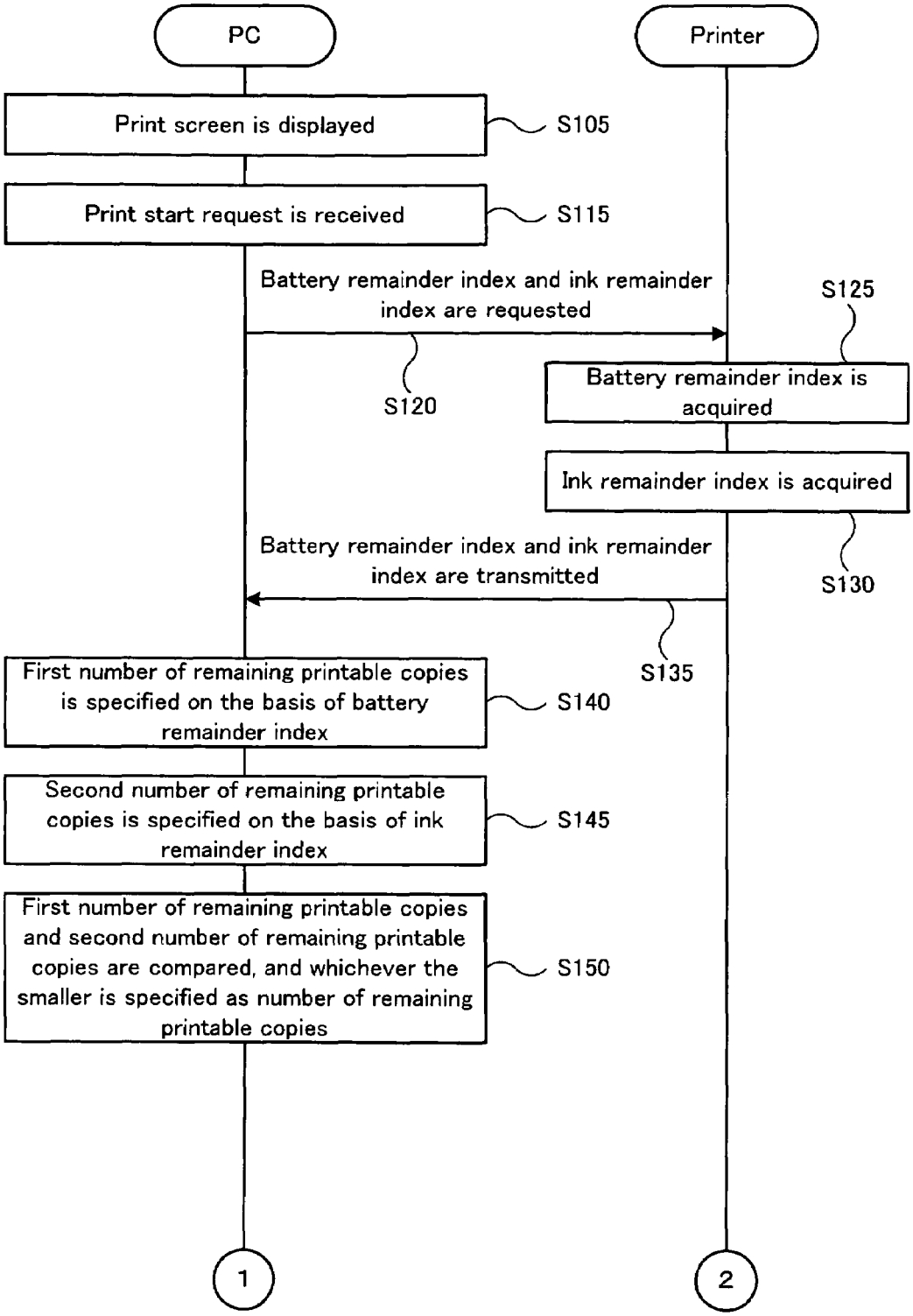
FIG. 26 is a sequence chart.
Figure 27:
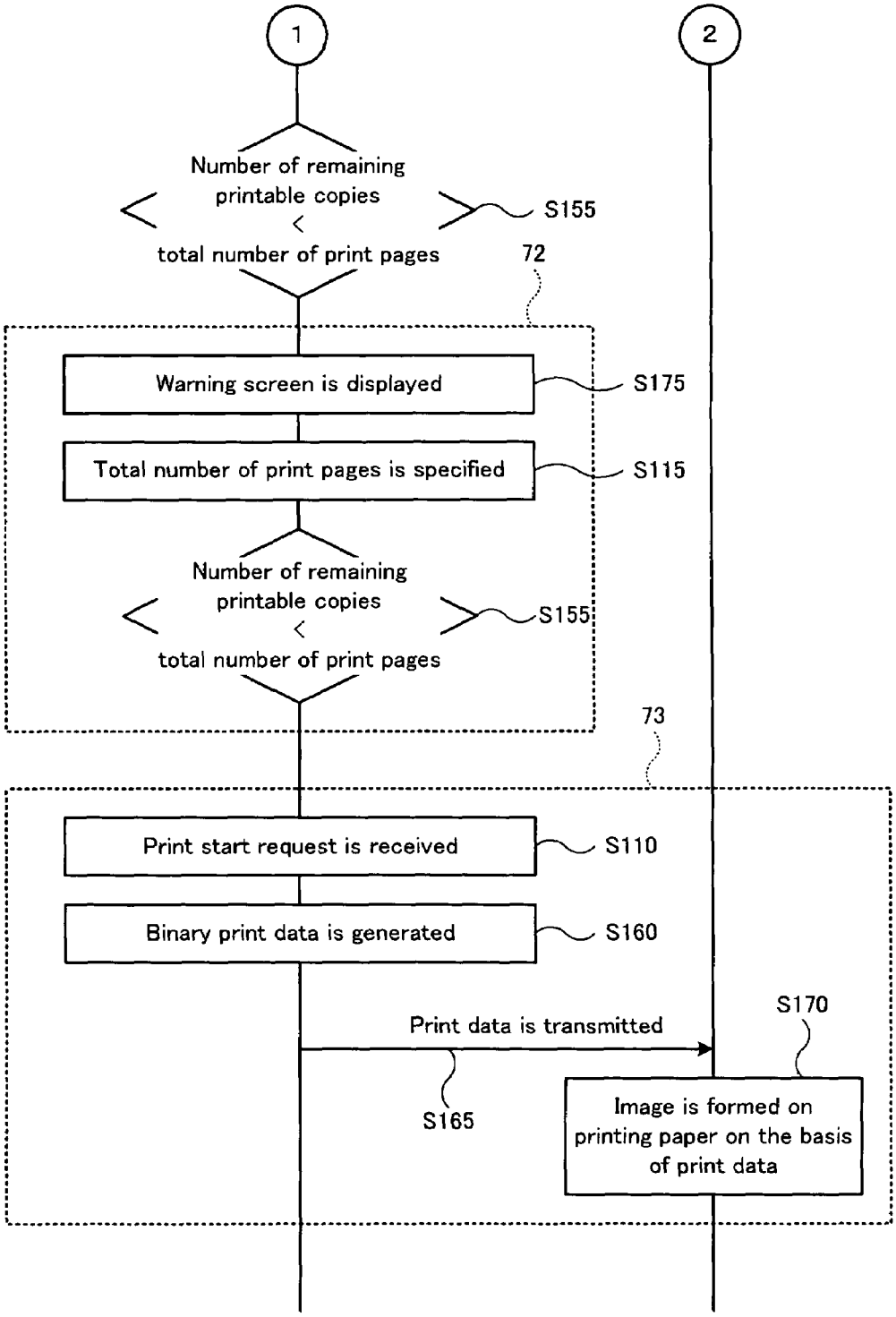
FIG. 27 is a sequence chart.

FIG. 26 and FIG. 27 are sequence charts showing processing flow of the printing system in the second embodiment. The sequence charts shown in FIG. 26 and FIG. 27 are different in the execution sequence from the sequence charts in the first embodiment. Specifically, the process of receiving the print start request (process at S110) comes after the process of comparing the number of remaining printable copies and the total number of printing pages (process at S155) in the second embodiment. That is, in the second embodiment, the CPU 11 immediately compares the number of remaining printable copies and the total number of printing pages when any one of the desired pages to be printed, number of print copies, or print mode is changed. As a result, when the number of remaining printable copies is less than the total number of printing pages, the operation advances to the process enclosed by broken line 72. In the process enclosed by broken line 72, the warning screen 62 is displayed every time a change is made until the number of remaining printable copies becomes more than the total number of printing pages. If the number of remaining printable copies is less than the total number of printing pages, the user must change the setting of the desired pages to be printed, number of print copies, or print mode until becoming more than the total number of printing pages. Or the rechargeable battery 30 must be charge or the ink cartridge 28 must be replaced. When the number of remaining printable copies becomes more than the total number of printing pages, the print button 56 can be pressed, and the operation advances to the process enclosed by broken line 73.

According to the printing system of the second embodiment, since allowance of print is judged before pressing the print button 56, the user knows printing is impossible at an earlier stage.

Third Embodiment of Third Printing System

The hardware of the printer 1 in the third embodiment of third printing system of the invention is same as in the second printing system shown in FIG. 11. The operation of the printer 1 in the third embodiment of third printing system is described below.

The CPU 52 reads out an image file recorded in a removable memory 86 in specified image format, and displays a reduced image of digital image stored in the image file in the display unit 46. The reduced image may be displayed in each image, or a plurality of reduced images may be displayed in list. The user manipulates the operation unit 48, and selects one or more reduced images to be printed. As a result, the images to be printed are selected, and the number of images to be printed is determined.

FIG. 28A is a schematic diagram showing a screen for accepting print setting operation. Specifically, for example, the print setting operation is accepted in the following procedure. When the CPU 52 controls the display unit 46 and displays the menu 91 on the screen, the user can select any one of setting items by pressing the cross key or the like. The print mode is determined by combination of selected setting items such as the print size, paper type, and print quality. While a specific item is being selected (the selected item is highlighted), the decide key or the like is pressed, and a new menu appears to allow to change the printing condition any corresponding item. The determined print mode is uniformly applied to selected digital images. Or the print mode may be set in each digital image.

When the print start key or the like is pressed while the menu 91 is being displayed, the print start request is accepted. When the print start request is accepted, the CPU 52 judges whether or not to print on the basis of the number of remaining printable copies and the total number of printing pages, before generating binary print data, same as in the first embodiment, and when the print is rejected, a warning message 92 is displayed as shown in FIG. 28B. The total number of printing pages can be calculated by "the number of images to be printed×number of copies (number of prints)." When the print is accepted, print data is generated and the print is executed.

Within the scope not departing from the scope and true spirit of the invention, the foregoing embodiments may be changed and modified in various forms by those skilled in the art. For example, the first printing system, second printing system, and third printing system of the invention may be applied not only to the apparatus having printing function, but also to so-called multi-function machine having image reading function, copier, facsimile equipment and others. Further, the first printing system and second printing system of the invention, like third printing system, may be applied also to the printing system combining the PC and the printer.

What is claimed is:

1. A print control method comprising:

accepting setting of print mode;

measuring a battery remainder index correlating with a remaining capacity of a battery in a printing unit operating on the battery;

specifying a number of remaining printable copies of the printing unit; and outputting the number of remaining printable copies, wherein the number of remaining printable copies is specified based on the battery remainder index, and the accepted print mode, wherein the battery remainder index is specified based on a maximum number of printable pages and print time per page to calculate cumulative printing time, and mapping information correlating between the calculated cumulative printing time and terminal voltage of the battery in a case of a standard battery fully charged which is used in the accepted mode.

2. The print control method of claim 1, further comprising:

correcting the battery reminder index on the basis of the mapping information and printing time as a measured value of printing time per unit page using the standard battery, wherein the number of remaining printable copies is specified based on the corrected battery reminder index.

3. The print control method of claim 1, further comprising displaying a menu of print mode of the printing unit together with the number of remaining printable copies in the each print mode.

4. The print control method of claim 1, further comprising:

updating the number of remaining printable copies every time a specified number of pages are printed, wherein the number of remaining printable copies is specified based on the updated number of remaining printable copies.

5. A printing system comprising:

a measuring circuit that measures a battery remainder index correlating with the remaining capacity of a battery in a printing unit operating on the battery;

a specifying unit that specifies a number of remaining printable copies of the printing unit; and an output unit that outputs the number of remaining printable copies, wherein the number of remaining printable copies is specified based on the battery remainder index and an accepted set print mode, and wherein the battery remainder index is specified based on a maximum number of printable pages and print time per page to calculate cumulative printing time, and mapping information correlating between the calculated cumulative printing time and terminal voltage of the battery in a case of a standard battery fully charged which is used in the accepted mode.

6. The print control method of claim 1, wherein when specifying the number of remaining printable copies, the printing unit updates the number of remaining printable copies every time a specified number of pages are printed, and when outputting the number of remaining printable copies, the updated number of remaining printable copies is outputted during printing.

* * * * *